US007549218B2

(12) United States Patent
Sawada et al.

(10) Patent No.: US 7,549,218 B2
(45) Date of Patent: Jun. 23, 2009

(54) CONTINUOUS FINISHING APPARATUS FOR SLIDE FASTENER

(75) Inventors: Toshiaki Sawada, Toyama (JP); Makoto Yamazaki, Toyama (JP)

(73) Assignee: YKK Corporation, Tokyo (JP)

( * ) Notice: Subject to any disclaimer, the term of this patent is extended or adjusted under 35 U.S.C. 154(b) by 721 days.

(21) Appl. No.: 11/345,902

(22) Filed: Feb. 2, 2006

(65) Prior Publication Data

US 2006/0179648 A1 Aug. 17, 2006

(30) Foreign Application Priority Data

Feb. 16, 2005 (JP) ..... 2005-039591

(51) Int. Cl.
*A41H 37/06* (2006.01)
*B21D 53/50* (2006.01)
*B21F 45/18* (2006.01)

(52) U.S. Cl. ..... 29/766; 29/408; 29/409; 29/410; 29/767; 29/768

(58) Field of Classification Search ..... 29/408–410, 29/766–768

See application file for complete search history.

(56) References Cited

U.S. PATENT DOCUMENTS 2,219,165 A * 10/1940 Nedal ..... 29/408
3,629,926 A * 12/1971 Maeda ..... 29/768
4,237,604 A * 12/1980 Sawada et al. ..... 29/766
4,361,946 A 12/1982 Takamatsu
5,371,941 A 12/1994 Sen Gupta
2002/0144385 A1 10/2002 Takiyama
2004/0187301 A1 * 9/2004 Matsumura et al. ..... 29/768

FOREIGN PATENT DOCUMENTS

EP 1 437 058 A1 7/2004
JP 63-7761 2/1988
JP 6-71446 9/1994
JP 7-4291 1/1995

OTHER PUBLICATIONS

Australian Search Report of Appl. No. 2006/00637, dated May 31, 2006.

* cited by examiner

*Primary Examiner*—David P Bryant
*Assistant Examiner*—Alexander P Taousakis
(74) *Attorney, Agent, or Firm*—Alston & Bird LLP

(57) ABSTRACT

The invention is a continuous finishing apparatus for a slide fastener having a slider introduction portion for successively introducing a slider by intermittently running a slide fastener chain, wherein, a slider introduction member thrusts into the space portion when the slider held by a slider holding member is brought into a space portion and set therein, moves downstream of the slide fastener chain within the space portion, holds an engaging element disposed at a downstream end portion of the space portion, and then, continues to move to the downstream for carrying the slide fastener chain, and wherein the slider is introduced and set along the same chain upon this carriage. Because the slider introduction member carries the slide fastener by holding the engaging elements on an edge of the fastener tape, which is least elongated, no disagreement occurs in position of corresponding right and left engaging elements.

10 Claims, 17 Drawing Sheets

CONTINUOUS FINISHING APPARATUS FOR SLIDE FASTENER

BACKGROUND OF THE INVENTION

1. Field of the Invention

The present invention relates to a finishing apparatus and finishing method for finishing a short slide fastener from a long slide fastener chain, and more particularly, to a finishing apparatus for finishing a slide fastener, having a feature in its feeding mechanism for the slide fastener chain when a slider is set on the slide fastener chain.

2. Description of the Related Art

Conventionally, for example, Japanese Patent Publication (JP-B) No. 63-7761 has proposed a method for continuously carrying out attaching a slider and a top end stop to a long slide fastener chain in a same process, wherein an engaging portion and a space portion having no engaging element are disposed alternately in a process of manufacturing the slide fastener. According to this method, a bottom end stop is attached preliminarily to an end portion in a downstream of the space portion of such a long continuous fastener chain. The fastener chain is carried in a single direction by upper and lower feed rollers each having a passage space for the engaging elements in mesh. If an end portion in an upstream of the space portion is detected by a sensor, grippers grip right and left fastener tape portions of the space portion based on this detection signal and advance by a predetermined distance. In addition, the grippers move in directions perpendicular to a feeding direction of the fastener chain and departing from each other so as to expand and open the space portion. A slider held by a slider holder is inserted into an opening made by this expansion and set therein. With this state, the gripping of the grippers is released, so that inner edges of the right and left fastener tape portions are inserted into engaging element guide passages in the slider. During this time, the grippers return to a standby position.

Subsequently, the slide fastener chain is carried backward and stopped at a position in which the bottom end stop strikes a head of the slider or near that position. As a result of this operation, the inner edges of the tape portions of the space portion completely get into the engaging element guide passages of the slider. Then, the fastener chain is advanced and stopped at a position in which plural engaging elements in mesh disposed at a front end of an engaging element row are fitted into a rear mouth portion of the slider. The slider is released from holding by the slider holder.

On the other hand, a top end stop composed of a U-shaped piece is held by a groove portion formed between a main actuating lever and a subsidiary actuating lever of a top end stop holder in advance. A front end portion of the main actuating lever is formed in a shape of an anchor, and the subsidiary actuating lever is movable from the proximal portion of the main actuating lever toward the anchor at the front end portion. With this state, the top end stop holder is moved, so that the anchor-shaped front end portion gets into the space portion. After the right and left fastener tape portions are expanded and the top end stop is set on the inner edges of the tapes, the slide fastener chain is advanced slightly so as to bring the engaging element on the end portion in the upstream of the space portion into contact with an end face of the top end stop. The front end of the main actuating lever is pressed by a punch, so that the top end stop held in the groove portion between the main actuating lever and the subsidiary actuating lever is clamped, and consequently, the top end stop is clamped and fixed to the fastener tape portion of the space end portion. After an attachment of the top end stop is finished, an expansion lever thrusts into the space portion and expands to widen the space portion, and then, the top end stop is released from the top end stop holder. The top end stop holder and the expansion lever leave the space portion.

According to, for example, JP-B No. 6-71446, while a gripper unit grips front end portions of a slide fastener chain and advances by a predetermined distance along a finish processing passage, a space portion is opened by a cam plate, and a slider held by a slider holder thrusts into the opening so as to set the slide fastener chain in the slider. While a setting of the slider is executed, a following space portion is detected by a sensor, and when the end portion in the upstream of the space portion reaches a bottom end stop attachment position, the advancement of the gripper unit is stopped. A punch is actuated so as to clamp and fix a bottom end stop preliminarily formed in a U-shape by a bender to an end portion in the upstream of the space portion. At the same time when the bottom end stop is attached, a cutting device is actuated so as to cut the slide fastener chain in a center of the space portion. After this cutting is finished, the aforementioned gripper unit starts advancement again, and a unit of the slide fastener equipped with the slider and bottom end stop is discharged in a downstream. After this discharge is finished, the gripper unit returns to its original position so as to grip the front ends of the slide fastener chain after the cutting. Therefore, carriage of the slide fastener chain according to the JP-B No. 6-71446 is carried out by gripping of the front end and the advancement action of the gripper unit.

The above mentioned JP-B No. 63-7761 and JP-B No. 6-71446 have proposed methods for finishing a slide fastener from a general continuous slide fastener chain, and the above-described finishing can be carried out continuously in a state in which a plurality of narrow fabric pieces called fly of trousers are sewed preliminarily on the slide fastener chain in a longitudinal direction. Upon finishing, as disclosed in, for example, JP-B No. 7-4291, a fly attached to the slide fastener chain is folded into two in a width direction along a sewing line and introduced into the finishing apparatus in a state in which a row of engaging elements in mesh is exposed outside. In the slide fastener chain with the twofold fly, a fabric thickness in the width direction of the slide fastener chain necessarily differs largely across a row of engaging elements in mesh.

According to JP-B No. 7-4291, in order to prevent positions of the engaging elements to be meshed from deviating because of a twisting force applied due to a difference in the fabric thickness when the slide fastener chain is carried, each finishing process of setting the slider and attaching the bottom end stop is carried out while the slide fastener chain with the folded fly runs. In this finishing process, in an intermediate portion between a position in which a slider is to be set and a position in which the bottom end stop is to be attached, the continuous slide fastener chain is run on a drive roller which makes contract with the fastener tape on a side on which the fly has been sewed and the fastener tape on a side on which no fly is sewed. When the slider is set, the slide fastener is carried by disposing a first subsidiary actuating roller which makes contact with the fastener tape with the fly and a second subsidiary actuating roller which makes contact with the fastener tape without the fly on the fastener tapes so as to contact with them. The first and second subsidiary actuating rollers opposing are disposed above the drive roller so as to be opposed to it. After the slider is set on, the first subsidiary actuating roller is raised apart from the fastener tape with the fly, and then, the slide fastener chain is carried only by the second subsidiary actuating roller.

According to the JP-B No. 63-7761 and JP-B No. 7-4291, the slide fastener chain is carried with its fastener tape portion sandwiched by a drive roller and a driven roller. Slippage occurs between the rollers and the fastener tape in such carrying with the rollers, or a difference in carrying speed or a difference in tension force occurs between right and left corresponding fastener tapes. Consequently, positions of right and left engaging elements to be meshed deviate, so that engagement between the corresponding engaging elements is disabled, thereby producing causes for generation of defective product. In carrying a slide fastener chain with the fly as mentioned in JP-B No. 7-4291, tensile forces acting on a fastener tape on which the fly has been sewed and a fastener tape on which no fly is sewed are often unequal, so that a difference occurs in an elongation of the fastener tape, thereby likely generating a deviation in the positions of the engaging elements as described above.

On the other hand, according to JP-B No. 6-71446, there is no-fear of slippage because the slide fastener chain is carried not by rollers but by a gripper unit. However, since the slide fastener chain is carried with its right and left fastener tapes pulled directly by gripping, and at the same time, opening and closing action is applied to its space portion, more elongation than in carrying with the rollers is likely to occur in the right and left fastener tapes, thereby likely generating a deviation in the positions of the right and left engaging elements.

According to the above-mentioned three publications, the finishing process of any method is constituted of independent finishing steps and a necessary finishing member is actuated independently for each process. As a consequence, not only unreasonable force is applied to the slide fastener chain a plurality of times, but also a complicated work for highly accurately adjusting an operation timing is needed, which makes it very difficult to increase a processing speed and reduce finishing time.

SUMMARY OF THE INVENTION

An object of the present invention is to provide a continuous finishing apparatus and finishing method for a slide fastener which intends to rationalize the above-described conventional continuous finishing process and improves yield by eliminating any deviation of a position between right and left engaging elements, which may occur during the finishing process, while enabling high speed processing.

The above-described object is achieved effectively by the major feature of a continuous finishing apparatus for a slide fastener comprising a slider introduction portion for successively introducing a slider by running a slide fastener chain intermittently in which a meshed engaging element row and a space portion having no engaging element are disposed alternately in a longitudinal direction, wherein the apparatus comprising: an opening and closing member capable of thrusting into and departing from the space portion of the slide fastener chain, the an opening and closing member opening and closing the space portion; a slider holding member which is disposed in a downstream of the chain relative to the opening and closing member and which advances to and retreats from the space portion opened by the opening and closing member; and a slider introduction member disposed in a downstream of the chain relative to the slider holding member, the slider introduction member being capable of thrusting into and departing from the opened space portion; being reciprocated between a first position in the space portion and a second position in the downstream of the slide fastener chain; while it goes forward, supporting an engaging element disposed at a second end portion in the downstream of the slide fastener chain of the space portion and moving up to the second position while pulling the slide fastener chain so that the engaging element row disposed at the first end portion of the space portion on an upstream is inserted into the slider held by the slider holding member.

According to the present invention, the opening and closing member may have a positioning function for positioning a stop position of the first end portion in an upstream of the slide fastener chain of the space portion. Further, the slider introduction member may act as a top end stop attaching member. More specifically, the slider introduction member comprises: notch portions that support the top end stop and guide fastener tape side edges of the space portion in engagement; and a top end stop attaching means that attaches the top end stop supported by the notch portions to the second end portion of the space portion. In this case, preferably, the top end stop attaching means has changing means for changing a notch width of the notch portions. As well as an attachment of the top end stop, the present invention may further comprise a bottom end stop attaching member disposed in the downstream of the slide fastener chain of the slider introduction member, for attaching a bottom end stop to the first end portion of the space portion. The present invention may further comprise a space portion expanding member that is disposed between the slider introduction member and the bottom end stop attaching member and which thrusts into the space portion so as to expand an opening width of the space portion.

It is important that the slide fastener chain is carried by the slider introduction member at a time of finishing. However, preferably, a feed roller portion comprising a drive roller and a pressure roller is disposed further in the downstream of the second position in the downstream of the slide fastener chain, which is a mobility limit of one side for the slider introduction member while the drive roller is rotatable synchronously with a motion of the slider introduction member.

The bottom end stop attaching member comprises end stop bending means and clamping means comprising a punch and a die. A positioning opening and closing member, the slider holding member, and the end stop bending means and the punch of the bottom end stop attaching member are disposed in a first arrangement area on one side of a running plane of the slide fastener chain while the die of the bottom end stop attaching member, the space portion expanding member and the slider introduction member are disposed successively in a downstream direction of the slide fastener chain in a second arrangement area on the other side of the running plane of the slide fastener chain. Preferably, the positioning opening and closing member, the slider holding member, and the end stop bending means and the punch of the bottom end stop attaching member are disposed at immobile positions. The die of the bottom end stop attaching member, the space portion expanding member and the slider introduction member are supported by a single supporting member and unitized while the die and the space portion expanding member reciprocate in cooperation with the reciprocation of the slider introduction member between the first and second positions.

In the continuous finishing apparatus for the slide fastener of the present invention having the above-mentioned basic structure, the opening and closing member thrusts into the space portion if a next space portion of a slide fastener chain carried by the finishing apparatus is detected by, for example, a photoelectric sensor. When the first end portion which is an end portion in the upstream of the space portion makes contact with this opening and closing member, transportation of the slide fastener chain is stopped so that a stop position of the slide fastener chain is positioned. In this case, the opening and closing member is equipped with the positioning function at the same time. Immediately after the positioning is finished, the opening and closing member departs from the first end portion slightly so as to release the tensile force of the slide fastener chain temporarily.

Here, the slider holding member begins to advance toward the space portion while holding the slider. Subsequently, the opening and closing member is opened in a direction perpendicular to a chain carrying direction so as to open the space portion, and the slider is set in the space portion. Almost at the same time, the slider introduction member advances toward the space portion, and thrusts into a first position of the space portion. After this thrust ends, the opening and closing member returns from its opening state to its closed state, and retreats from the space portion. Due to this retreat of the opening and closing member, the side edges of the fastener tapes of the space portion are introduced into engaging element guide passages in the slider.

At the same time when the slider introduction member thrusts into the space portion, it moves toward the second position in the downstream of the slide fastener chain within the space portion. As a result of this movement, the slider introduction member comes into contact with an engaging element disposed at the second end portion, which is an end portion in the downstream of the slide fastener chain in the space portion and continues to move while supporting the same engaging element. As a result of this movement, the slide fastener chain moves while being pulled by the slider introduction member in the same direction, so that the slide fastener chain is inserted into the slider held by the slider holding member.

Transportation of the slide fastener chain by the slider introduction member is the most prominent composition of the apparatus and method of the present invention. That is, in a slider introduction process for the slide fastener chain, a portion of the fastener tape is not gripped by rollers or a gripper for transportation unlike conventionally, but the slider introduction member supports engaging elements in mesh located at an end portion of the space portion of the slide fastener chain, and carries via the engaging elements with a core thread portion of the fastener tape tensed. As a consequence, no carrying force is applied to the fastener tape, and thus, an influence of elongation of the tape is eliminated, thereby generating no deviation of the positions of the engaging elements.

When the slider introduction member is concurrently used as a top end stop attaching member, an operation of attaching the top end stop to a side edge of the fastener tape is preferably started at the same time when the slider introduction member begins to move from the first position within the space portion. More specifically, when the slider introduction member begins to move from the first position to the second position, a U-shaped top end stop supported by a notch portion formed in the front end portion of the slider introduction member is clamped to the side edge of the fastener tape by starting an operation of the top end stop attaching means so as to narrow a width of the notch portion. Then, when the slider introduction member reaches the second end of the space portion, the clamping action for the top end stop by the top end stop attaching means is ended, so that the top end stop is attached to the fastener tape portion at the second end of the space portion.

After an attachment of the top end stop is ended, the slider introduction member still continues to move and moves to the second position as pulling the slide fastener chain while supporting the top end stop attached to the side edge of the fastener tape and supported strongly by the notch portion in the slider introduction member. While it moves from a position in which the attachment of the top end stop is ended to the second position, a plurality of the engaging elements in mesh disposed at the first end in the upstream of the slide fastener chain of the space portion are introduced into the slider held by the slider holding member through a shoulder mouth of the slider. After the plurality of the engaging elements in mesh are introduced into the slider, the slider holding member is retreated away from the slide fastener chain by releasing a holding of the slider by the slider holding member. Thereby, the engaging elements can be introduced securely into the slide fastener even if a column of the engaging elements in mesh is short.

According to the present invention, when the bottom end stop attaching member is provided in the downstream of the slide fastener chain relative to the slider introduction member, the bottom end stop may be automatically attached to the first end of the space portion at a side on which the slider is introduced. The attachment position of the bottom end stop attaching member is determined depending on a moving distance of the slide fastener chain moved together with a movement of the slider introduction member, that is, a distance for introduction of the slider, in other words, a moving distance of the space portion. Thus, the attachment position is the position of the first end in the upstream of the slide fastener chain when moving of the space portion ends. The bottom end stop attaching member may have clamping means comprising end stop bending means, a punch and a die. In this case, after the end stop piece is bent into a U shape by the end stop bending means, the punch is actuated toward the first end of the space portion disposed on the die so as to clamp the bottom end stop against the first end portion and fix thereon.

The space portion expanding member for expanding the opening width of the space portion may be disposed between the slider introduction member and the bottom end stop attaching member. In this case, at the same time when the bottom end stop is attached to the first end portion, the space portion expanding member thrusts into the space portion and expands the space portion. With that expansion, the slider introduction member releases the top end stop and moves out of the space portion. According to the present invention, the aforementioned feed roller portion may be disposed in the downstream of the slide fastener chain relative to the second position in the downstream of the slide fastener chain. In such a case, when the slider introduction member moves to carry the slide fastener chain, a length of the slide fastener chain carried by the slider introduction member can be equalized with a length of the slide fastener chain sent to a next process by a rotation of the drive roller. Upon transportation, the slider introduction member maintains a state in which it is in contact with the end portion in the downstream of the space portion and inhibits the slide fastener chain from being tensed.

Particularly when the die of the bottom end stop attaching member, the space portion expanding member and the slider introduction member, disposed in the second arrangement area on the other side of the running plane of the slide fastener chain are supported by a single supporting member and constructed into a unit, they cooperate with a reciprocation of the slider introduction member between the first and second positions except a timing of advance and retraction of these components with respect to the space portion. For this reason, these components are moved always with a constant interval among the respective components. Thus, the attachment of the top end stop, the introduction of the slider and the attachment of the bottom end stop are automatically carried out in succession only by moving of the slider introduction member from the first position to the second position, thereby achieving compactness of the apparatus and high speed finishing. At this time, by setting an interval between the die and the slider introduction member equal to a dimension between the first end and the second end in the space portion, the bottom end stop may be attached to the first end in the upstream of the slide fastener chain in the space portion when the slider introduction member reaches the second position.

By starting to send the slide fastener chain by means of the feed roller portion comprising the drive roller and the driven roller disposed in the downstream of the slide fastener chain relative to the second position with a predetermined time lag from a feeding startup time of the slide fastener chain by the slider introduction member, the slide fastener chain may be sent out with the slider introduction member kept in contact with the top end stop and engaging elements. Additionally, no excessive tension by the feed roller portion is applied to the slide fastener chain located between the slider introduction member and the feed roller portion.

DESCRIPTION OF THE PREFERRED EMBODIMENTS

Hereinafter, preferred embodiments of the present invention will be described specifically with reference to accompanying drawings.

Figure 1:
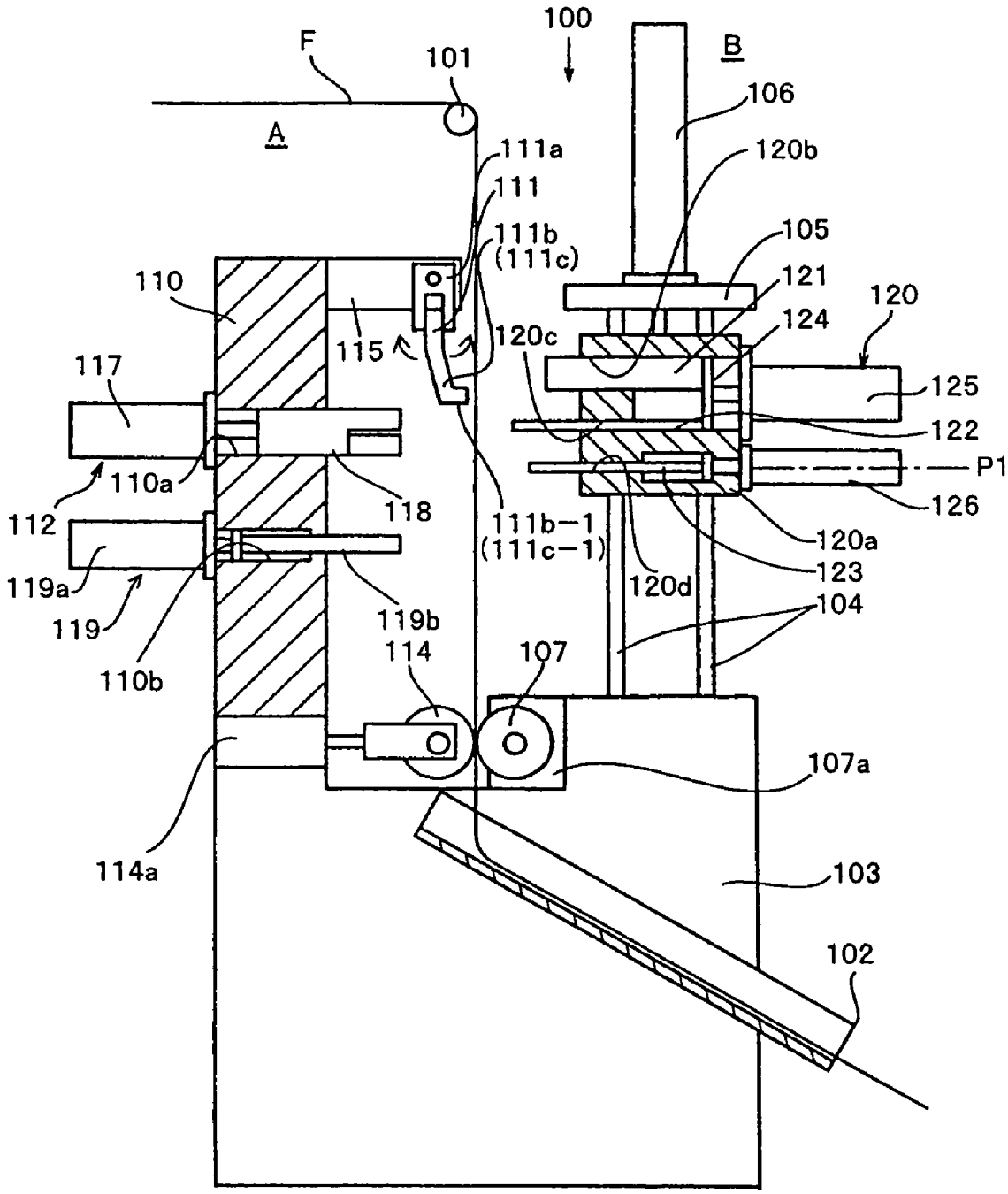
FIG. 1 is a partially broken side view schematically showing an entire structure of a continuous finishing apparatus for a slide fastener according to the present invention.

FIG. 1 is a structure view schematically showing a typical embodiment of a continuous finishing apparatus for a slide fastener according to the present invention.

As indicated in the same figure, according to this embodiment, a slide fastener chain FC is carried horizontally from a previous step and turned by 90° by a first guide roller 101 above a finishing apparatus 100 of the invention and then carried vertically downward. Thereafter, it is discharged out of the apparatus along a discharge passage 102 disposed immediately beneath. However, the continuous finishing apparatus of the present invention is capable of continuously carrying out all finishing processes while the slide fastener chain FC is carried horizontally along a chain carrying passage.

Figure 2:
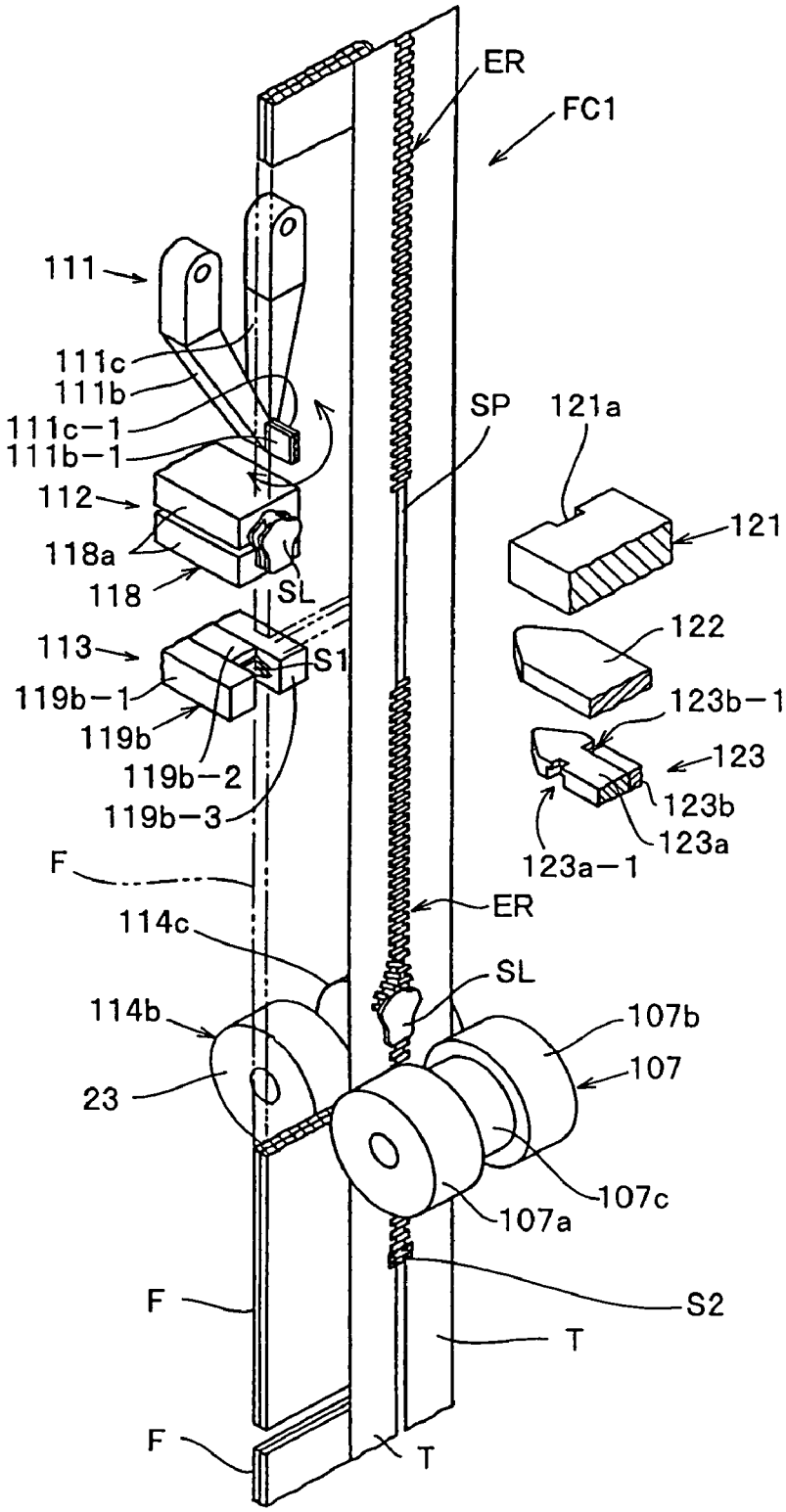
FIG. 2 is a perspective view schematically showing an arrangement of respective components of the continuous finishing apparatus and a configuration of major portions.
Figure 20:
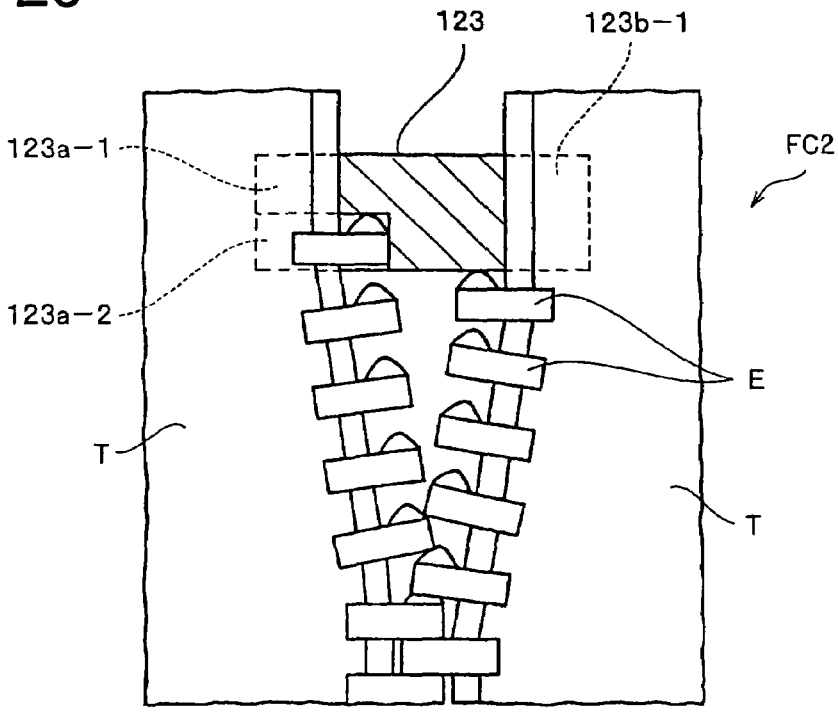
FIG. 20 is an explanatory view showing a modification of an embodiment provided with no top end stop.
Figure 21:
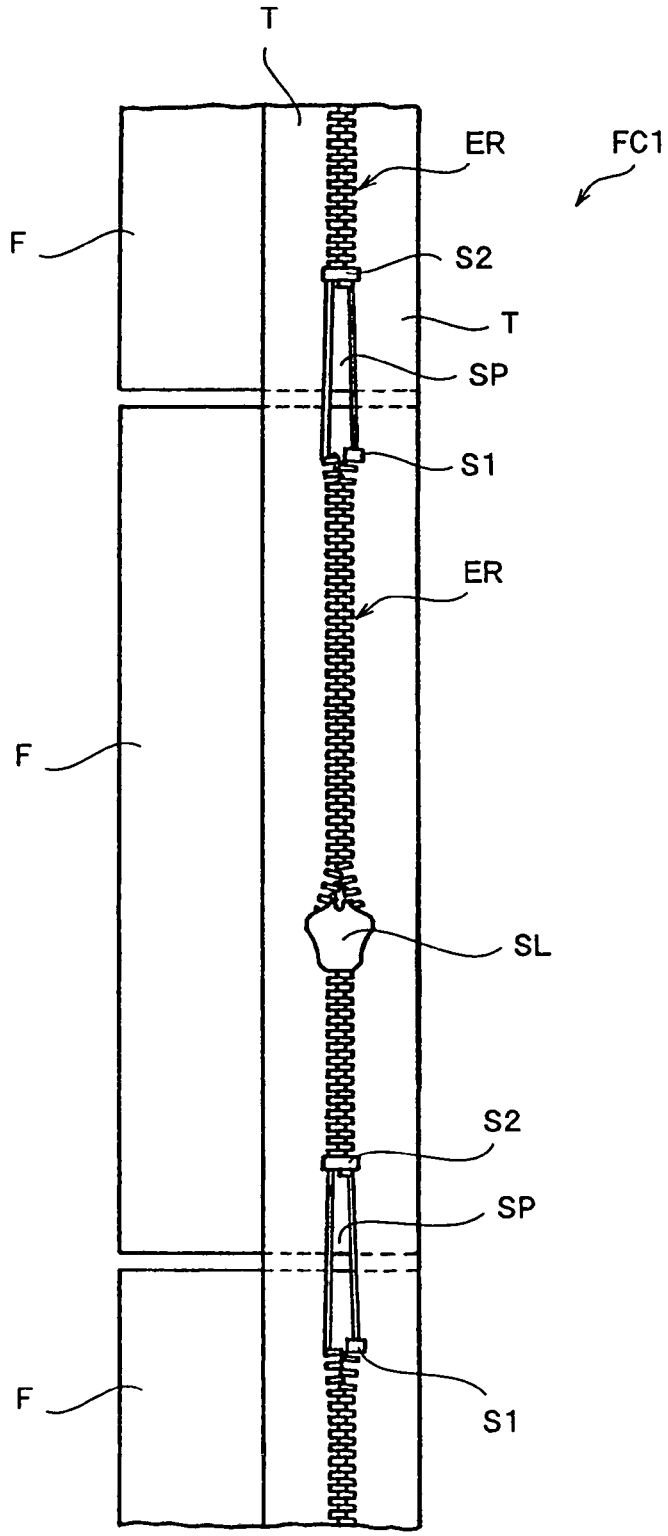
FIG. 21 is a rear view of the slide fastener chain with a fly.
Figure 22:
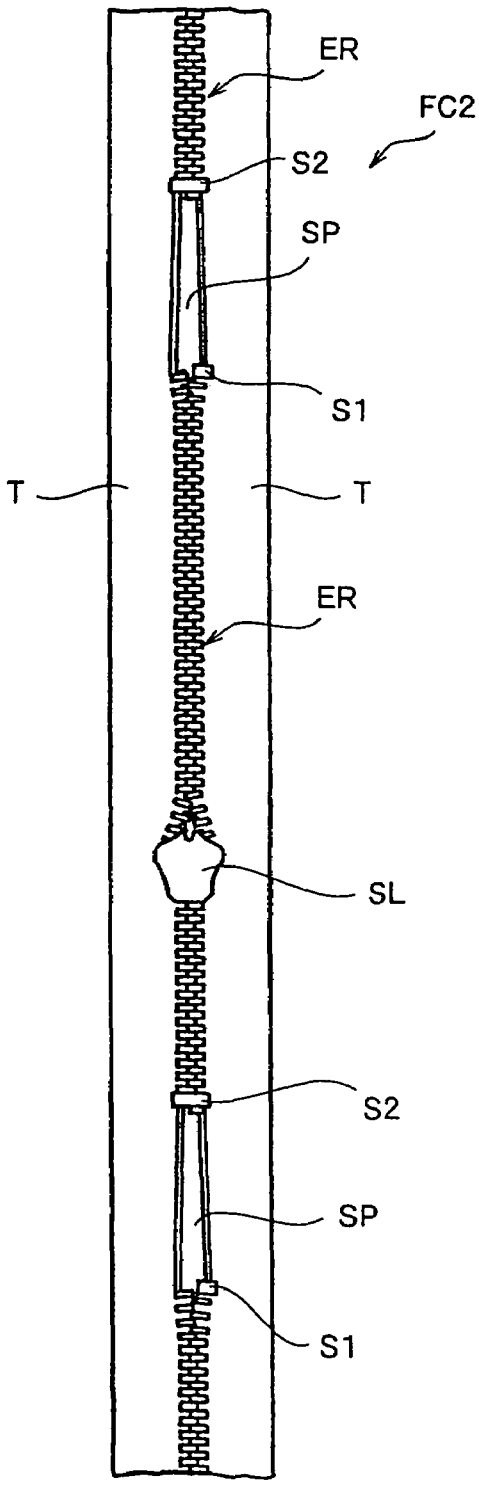
FIG. 22 is a rear view of a slide fastener chain without any fly.

According to this embodiment, while the slide fastener chain FC is carried vertically, a top end stop (not shown) is attached to a second end portion in a downstream of a slide fastener chain of a space portion of the slide fastener chain FC by the continuous finishing apparatus 100 of the present invention. A slider (not shown) is introduced into the same slide fastener chain FC, and then, a bottom end stop is attached to a first end stop portion, which is an end portion in an upstream of the space portion. The slide fastener chain FC includes a slide fastener chain FC1 with a fly in which a fly (fabric piece) F used for a fly of trousers is sewed on one fastener tape T as shown in FIGS. 2 and 21, and a slide fastener chain FC2 on which no fly is sewed as shown in FIGS. 20 and 22. Any one of the slide fastener chains FC1, FC2 comprises a pair of right and left fastener tapes T, a plurality of engaging element rows ER attached intermittently on opposing side edges of the fastener tapes T, and space portions SP in which the engaging elements E formed between respective engaging element rows ER are not provided. In the following embodiment, finishing of the slide fastener chain FC1 with fly will be described, and the ordinary slide fastener chain FC2 is finished completely in the same procedure except carrying operation by the feed roller portion.

In the continuous finishing apparatus 100 for the slide fastener, a column 110 is stood in a first arrangement area A on a left side of the same figure across the slide fastener chain FC above a base 103. A positioning opening and closing member 111, a slider holding member 112, a punch portion 119 which is part of a bottom end stop attaching member 113 and a pressure roller 114 which is part of a chain feed portion are mounted in this order from a top on the column 110. On the other hand, a plurality of guide rods 104 are stood vertically in a second arrangement area B on a right side of the same figure across the carrying face of the slide fastener chain FC above the base 103, and a cylinder mounting base 105 is fixed to top ends of the guide rods 104. A first cylinder 106 is fixed on a top face of the cylinder mounting base 105 such that its rod end faces downward. A chain carrying unit 120, through which the guide rods pass, is fixed and supported at a rod end of the first cylinder 106. In addition, a drive roller 107, which is rotated by driving of a drive motor 107*a*, is provided at a position opposing the pressure roller 114 above the second arrangement area B of the base 103. The pressure roller 114 is a free rotation roller, which is fixed to a rod end of a fourth cylinder 114*a* fixed on the column 110. The pressure roller 114 constitutes a chain feed portion for the slide fastener chain FC1 together with the drive roller 107 fixed on the base 103.

The positioning opening and closing member 111 is constructed as follows. As shown in FIGS. 1 and 2, a top end of a forked swing piece 111*a* which swings toward the vertical carrying face is pivoted at a front end portion of a bracket 115 provided such that it projects from the top end of the column 110 toward the vertical carrying face of the slide fastener chain FC1. In addition, the top ends of first and second swing levers 111*b*, 111*c* in pair which swing in a direction traversing the vertical carrying face are pivoted at a bottom end of the same swing piece 111*a*. The first and second swing levers 11*b*, 111*c* have stopper pieces 111*b*-1, 111*c*-l projecting toward the vertical carrying face at their bottom ends. The swing piece 111*a* and the first and second swing levers 111*b* and 111*c* swing together in cooperation toward the vertical carrying face, and at the same time, the first and second swing levers 111*b*, 111*c* swing such that they approach or leave each other in a direction traversing the vertical carrying face. These actions are carried out using, for example, a pushing lever and a cam mechanism although representation thereof is omitted.

Figure 5:
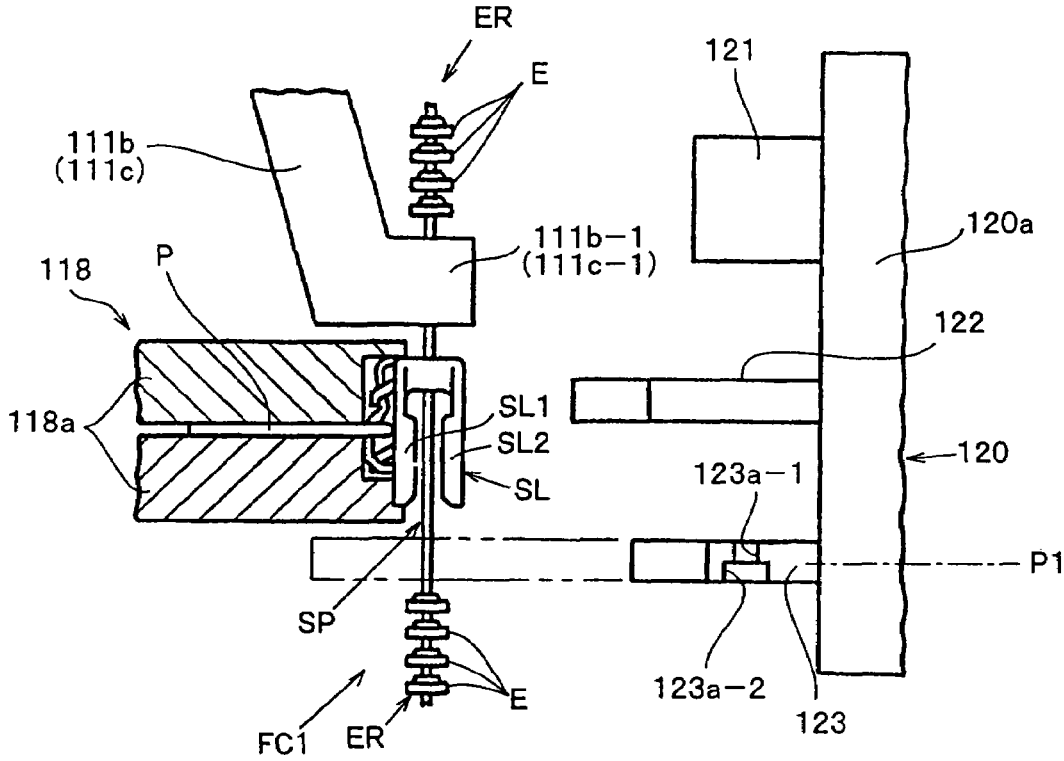
FIG. 5 is a partially broken side view showing a state of the slider held by a slider holding member when the slider invades.

As shown in FIGS. 2 and 5, the slider holding member 112 is provided below and adjacent to an installation position of the positioning opening and closing member 111 of the column 110. The slider holding member 112 comprises a second cylinder 117 and a slider holding portion 118 fixed at a rod end of the same cylinder 117. The second cylinder 117 is fixed on a rear face of the column 110. A first guide passage 110*a* is provided horizontally so as to pierce the same column 110 in order to advance and retract the slider holding portion 118 to and from the chain carrying passage by an activation of the second cylinder 117. As shown in FIG. 5, the slider holding portion 118 has upper and lower grippers 118*a*. With a body of the slider SL kept in contact with front faces of the same grippers 118*a*, its pull P is nipped by the upper and lower grippers 118*a* so as to hold the slider SL. The upper and lower grippers 118*a* are capable of releasing a gripping of the pull P using a cam and spring (not shown).

The punch portion 119, which is part of the bottom end stop attaching member 113, is provided below the slider holding member 112 on column 110. As shown in FIGS. 2 and 12 to 14, the punch portion 119 comprises a third cylinder 119*a* fixed on the rear face of the column 110 and a punch 119*b* which advances to and retreats from the chain carrying passage by an action of the cylinder 119*a*. For this purpose, a second guide passage 110*b* is provided so as to pierce the column 110 horizontally to enable the punch portion 119 to advance and retreat therethrough. As understood from FIGS. 2 and 13, the punch 119*b* is constituted by arranging first to third quadrangular prism pieces 119*b*-1 to 119*b*-3 so that they are slidable relatively to one another, and a second quadrangular prism piece 119*b*-2 disposed in a center acts as a punch main body. The first to third quadrangular prism pieces 119*b*-1 to 119*b*-3 advance and retreat together relative to the chain carrying passage by the third cylinder 119*a*, and the second quadrangular prism piece 119*b*-2 in the center constituting the punch main body advances and retreats independently between the first and third quadrangular prism pieces 119*b*-1 and 119*b*-3.

The chain carrying unit 120 has a block shaped main body 120*a* which moves up and down guided by the guide block 104 stood on the base 103 by an action of the first cylinder 106. The block shaped main body 120*a* is provided with a die 121 which is part of a composition of the bottom end stop attaching member 113, a space portion expanding member 122 for expanding the space portion described later where no engaging element formed on the slide fastener chain FC1 is provided, and a slider introduction member 123 which constitutes the most prominent feature portion of the present invention, these components being arranged in this order from a top as shown in FIG. 1. The die 121 and the space portion expanding member 122 are connected through their rear faces opposite to the chain carrying passage by a connecting member 124 so that they are integrated. A rod end of a fifth cylinder 125 fixed on a rear face of the block shaped main body 120*a* is fixed to that connecting member 124. The die 121 and the space portion expanding member 122 are guided through a third and fourth guide passages 120*b*, 120*c* provided horizontally through the block shape main body 120*a*, so that they advance and retreat together relative to the chain carrying passage by an action of the fifth cylinder 125. The slider introduction member 123 disposed below the space portion expanding member 122 is mounted on a rod end of a sixth cylinder 126 fixed on the rear face of the block shaped main body 120*a*, so that it advances and retreats independently relative to the chain carrying passage along a fifth guide passage 120*d* provided horizontally so as to pierce the block shape main body 120*a*.

The die 121 is formed of a rectangular plate as shown in FIGS. 1 and 2, and a concave portion 121*a* is formed in a center of an end face on a side opposing the chain carrying passage. Further, the space portion expanding member 122 is also formed of a rectangular plate, and an end portion on a side opposing the chain carrying passage is formed in a shape of wedge isosceles triangle as viewed from a top. A thickness and a width of the die 121 are larger than a thickness and a width of the space portion expanding member 122. In addition, a position of a front end of the space portion expanding member 122 is projected longer to a side of the chain carrying passage than a position of a front end of the die 121.

Figure 7:
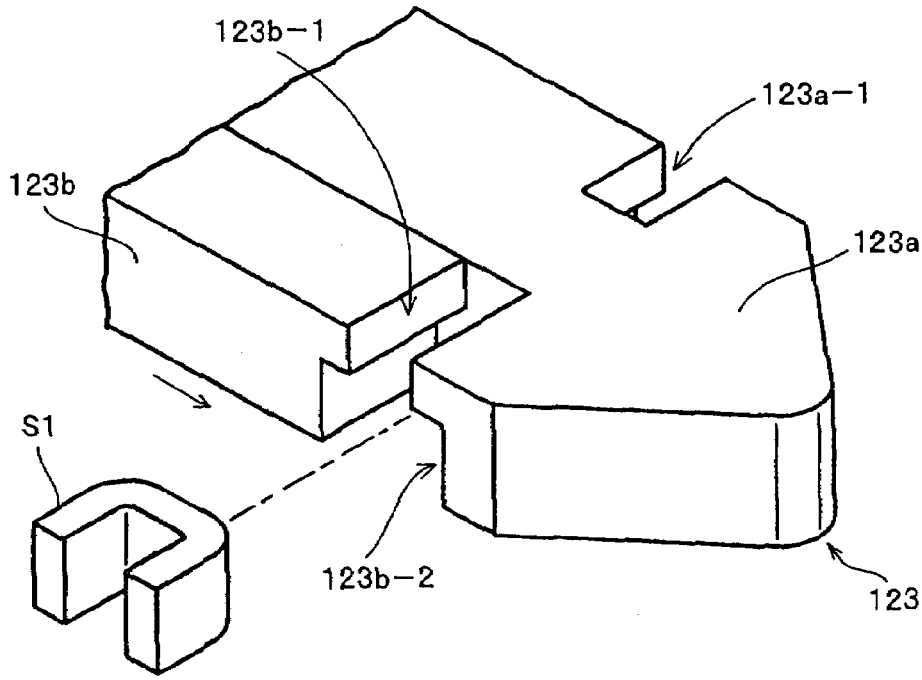
FIG. 7 is a partial perspective view showing a structure of a front end portion of the slider introduction member.
Figure 8:
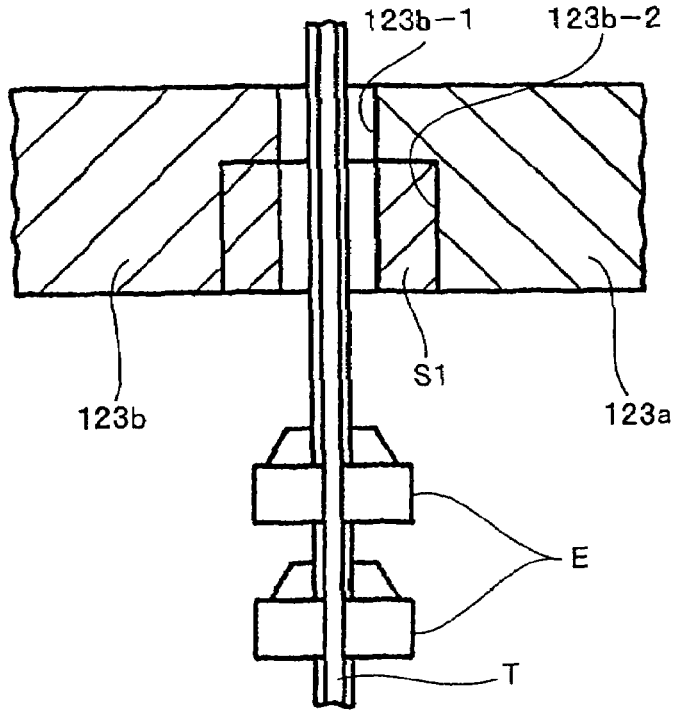
FIG. 8 is a partial sectional view showing a tape guide state by the slider introduction member before a top end stop is attached.

The slider introduction member 123 is formed of a rectangular member like the space portion expanding member 122, and a front end portion on a side opposing the chain carrying passage is formed in a shape of a wedge as viewed from a top like the space portion expanding member 122 as shown in FIGS. 2 and 7. A rectangular first and second notch portions 123*a*-1, 123*b*-1, which are extended inwardly in a plate width direction from right and left side faces, are formed at positions in a vicinity of a base portion of the wedge shape and adjacent to each other. The slider introduction member 123 is constituted of a first member 123*a* and a second member 123*b*. All the first notch portion 123*a*-1 and a bottom face of the second notch portion 123*b*-1 and an inner wall face on a side of a front end thereof are formed in the first member 123*a*, and the second member 123*b* forms an inner wall face on a side of a rear end of a second notch portion 123*b*.

According to this embodiment, the second member 123*b* is slidable with respect to the first member 123*a* along a side face inside the first member 123*a* so as to expand and reduce a width of a cutout of the second notch portion 123*b*-1. The first and second notch portions 123*a*-1, 123*b*-1 guide side edges of the right and left fastener tapes T exposed in the space portion of the slide fastener chain FC1 in a state in which they are inserted therein. The second notch portion 123*b*-1 guides the side edge of one fastener tape T with a top end stop S1 held in a state in which it is inserted therein as shown in FIG. 7. An expanded notch portion 123*b*-2 wide enough for holding the top end stop S1 is formed via a step portion in a bottom side of the second notch portion 123*b*-1. Further, an expanded notch portion 123*a*-2 large enough for accommodating an engaging element E is formed in an bottom side of the first notch portion 123*a*-1. Although, in this embodiment, the expanded notch portions, width of which are changed are distinguished from the first and second notch portions, width of which are fixed, in order to help understand these features, all of them are defined as the notch portions according to the invention.

The second member 123*b* functions as means for changing a size of the expanded notch portion 123*b*-2 for holding the top end stop S1. The second member 123*b* can change a notch width in case of holding the top end stop S1 in a contact state without deforming the same top end stop S1 and a notch width in case of fixing the top end stop S1 to the fastener tape T after deforming it plastically.

According to this embodiment, as described previously, the slider introduction member 123 is constituted of two members, first and second members 123*a*, 123*b*, right and left in pair. The top end stop S1 is held by the second notch portion 123*b*-1 formed between the first member 123*a* and the second member 123*b*, and the engaging element E is accommodated in the expanded notch portion 123*a*-2 of the first notch portion 123*a*-1 so as to guide the opposing side edges of the right and left fastener tapes T in a state in which they are inserted. It is permissible to constitute the slider introduction member 123 of three members, right, left and central ones and form the expanded notch portions 123*a*-2, 123*b*-2 via step portions in the first and second notch portions 123*a*-1, 123*b*-1, right and left such that the right and left members are slidable along the central member so as to hold a pair of the top end stops S1 in each expanded notch portion.

Figure 13:
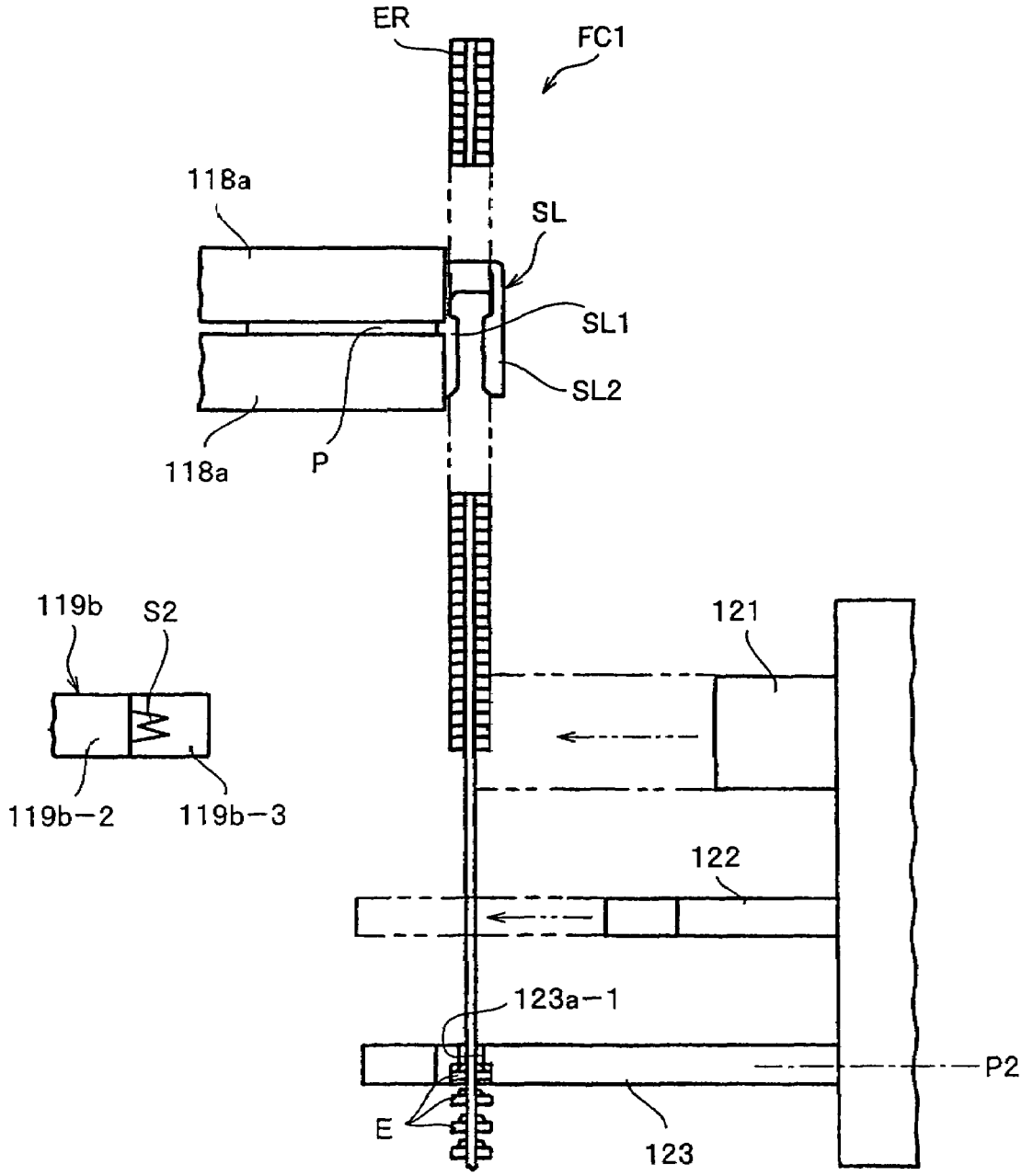
FIG. 13 is a side view showing a positional relation of a bottom end stop attaching member at the bottom limit end of a chain carrying unit and a die moving step.

The chain carrying unit 120 is reciprocated by an action of the first cylinder 106 between a first position (upper limit position) P1 indicated in FIG. 5 and a second position (lower limit position) P2 indicated in FIG. 13. In the first position P1, the slider introduction member 123 invades the space portion SP of the slide fastener chain FC1. The slider introduction member 123 is located in the second position P2 when the die 121 of the bottom end stop attaching member 113 reaches an attachment position of the bottom end stop S2 after the slider SL is introduced.

Next, a procedure of continuous finishing with the continuous finishing apparatus 100 for the slide fastener according to this embodiment having such a configuration will be described specifically with reference to the accompanying drawings.

After carried horizontally, the slide fastener chain FC1 is turned by 90° by the first guide roller 101 and carried downward vertically. While the slide fastener chain FC1 is carried downward vertically, introduction of the slider SL, attachment of the top end stop S1 and attachment of the bottom end stop S2 are automatically carried out continuously by the continuous finishing apparatus 100 of this embodiment.

Figure 3:
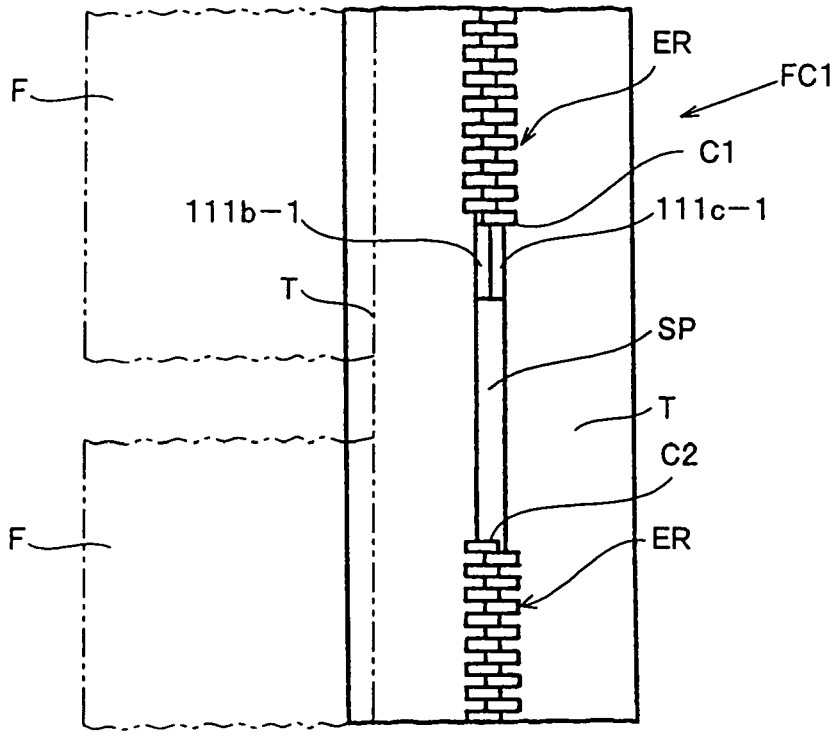
FIG. 3 is a partial front view showing a state in which a positioning opening member is inserted into a space portion of a slide fastener chain with a fly.

After a previous finishing is ended, a space portion SP of the continuously carried slide fastener chain FC1 to be finished next is detected by a sensor (not shown). After this detection, carrying in a predetermined length is performed. When the length is reached, the positioning opening and closing member 111 advances toward the slide fastener chain FC1, and the first and second swing levers 111*b*, 111*c* are swung forward with the respective stopper pieces 111*b*-1, 111*c*-1 projecting forward from bottom ends of the first and second swing levers 111*b*, 111*c* disposed on right and left kept in firm contact with each other, so that the respective stopper pieces 111*b*-1, 111*c*-1 are thrust into the space portion SP as shown in FIG. 3. By bringing top faces of the stopper pieces 111*b*-1, 111*c*-1 into contact with a bottom face of an engaging element E located at a first end portion C1 in the upstream of the space portion SP by a swing action at the time of this thrust, the slide fastener chain FC1 is positioned while it is slightly tensed. According to this embodiment, after this tensing, the positioning opening and closing member 111 is moved slightly to the downstream so as to relax the tensed state of the slide fastener chain FC1. The tensed state of the slide fastener chain FC1 may be relaxed by carrying the slide fastener chain FC1 slightly backward to the upstream.

Instead of positioning with the positioning opening and closing member 111, the positioning of the first end portion C1 may be executed by providing a positioning stopper member separately from the positioning opening and closing member 111 and bringing the stopper member into contact with the first end portion C1. Alternatively, by providing with a positioning sensor such as a photoelectric tube or a proximity switch, a control portion may instruct to turn the drive roller 107 of the feed roller portion by a predetermined angle after the same sensor detects the first end portion C1, so as to stop the slide fastener chain FC1 after it is carried by a predetermined length thereby achieving the positioning.

Figure 4:
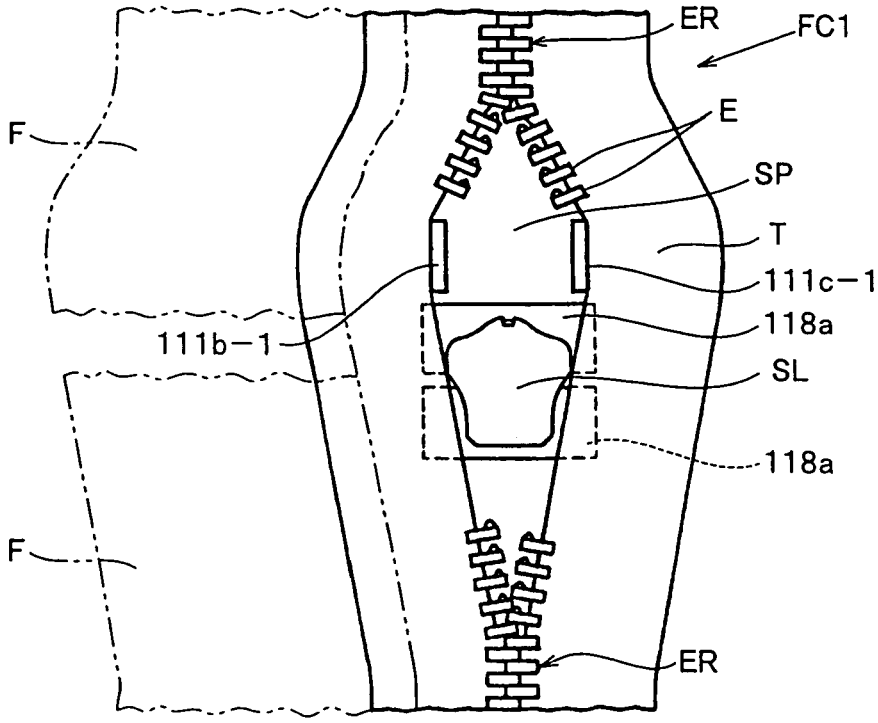
FIG. 4 is a partial front view showing a state in which with the positioning opening member opening a space portion, a slider invades the space portion.

Next, as shown in FIG. 4, the first and second swing levers 111*b*, 111*c* of the positioning opening and closing member 111 swing in a direction in which they depart from each other in a width direction of the slide fastener chain FC1 around their top ends so as to expand the space portion SP. Here, the second cylinder 117 is actuated in an extension direction so as to advance the slider holding member 112 toward the space portion SP while holding the slider SL with a shoulder mouth of the slider SL directed upward, thrust only the slider SL into the space portion SP and then stop it at a predetermined position. In the meantime, it is permissible to provide a cam for swinging the first and second swing levers 111*b*, 111*c* of the positioning opening and closing member 111 interlockingly with an advance of the slider holding member 112 and swing the first and second swing levers 111*b*, 111*c* during the advance of the slider holding member 112 so as to expand the space portion SP.

Figure 6:
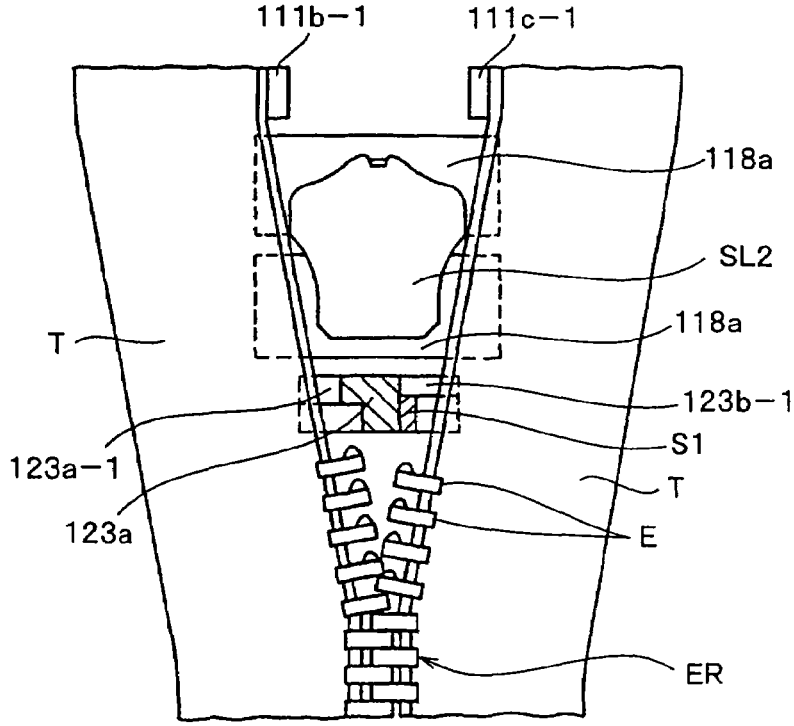
FIG. 6 is a rear view with a partial sectional view showing a invasion state of a slider introduction member that invades the space portion after the slider invades.
Figure 9:
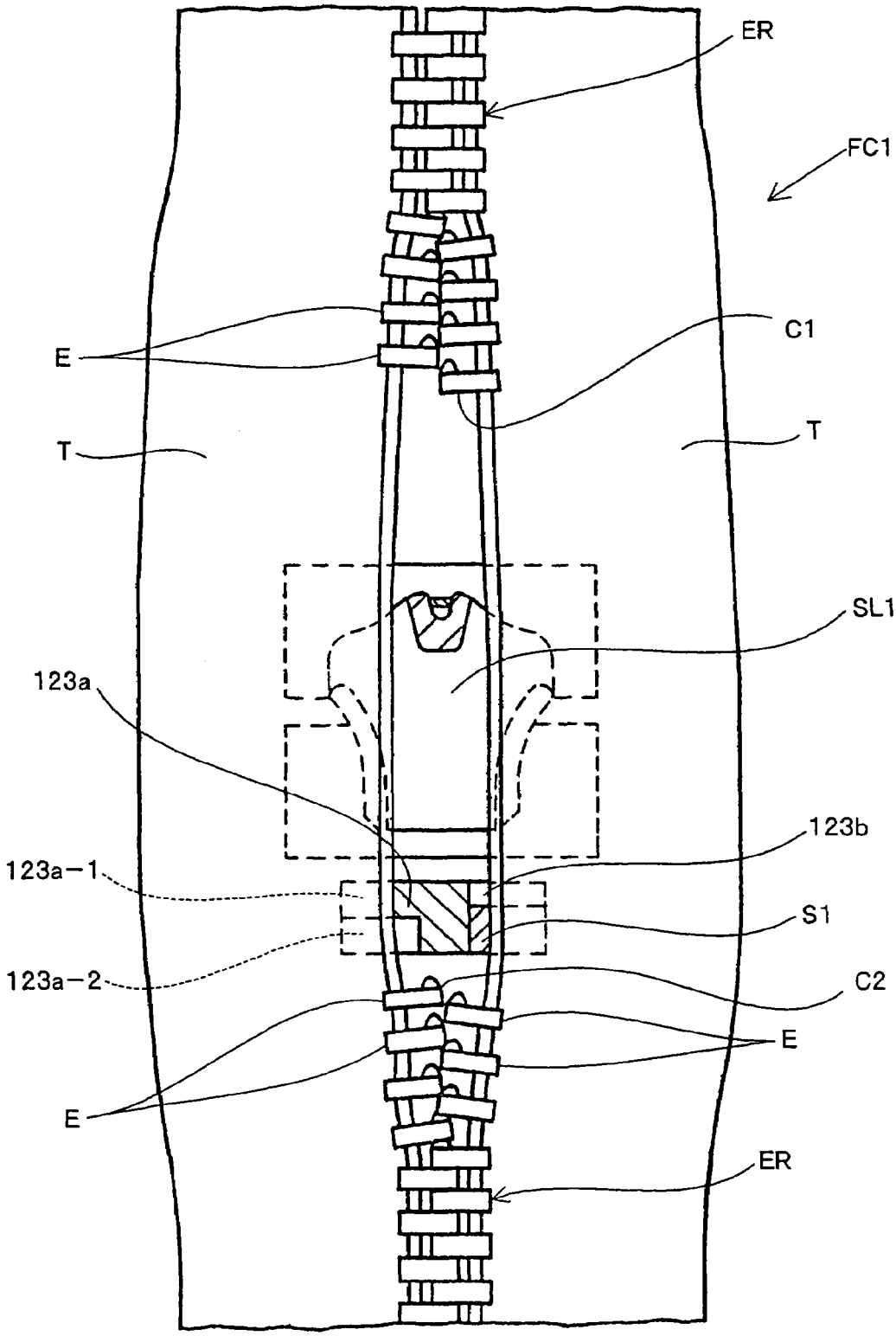
FIG. 9 is a rear view showing, with a cross section, a state in which right and left tape edges of the space portion are fitted into the slider and slider introduction member.

Substantially at the same time when the slider holding portion 118 advances, the sixth cylinder 126 of the chain carrying unit 120 disposed in the second arrangement area B is actuated. Then, as shown in FIG. 6, the slider introduction member 123 is advanced toward the space portion SP with a single U-shaped top end stop P1 held in the second notch portion 123*b*-1. When the slider introduction member 123 invades the space portion SP, the first and second swing levers 111*b*, 111*c* of the positioning opening and closing member 111 are closed and retreated to their original standby positions. By this retreat, the opening of the space portion SP is narrowed. At this time, as shown in FIG. 9, side edges of the pair of fastener tapes T located in the space portion SP are inserted into gaps between upper and lower blade plates SL1 and SL2 of the slider SL. One of the side edges is fitted between legs of the U-shaped top end stops S1 held in the expanded notch portion 123*b*-2 of the slider introduction member 123 while the other side edge is fitted into the first notch portion 123*a*-1.

Figure 10:
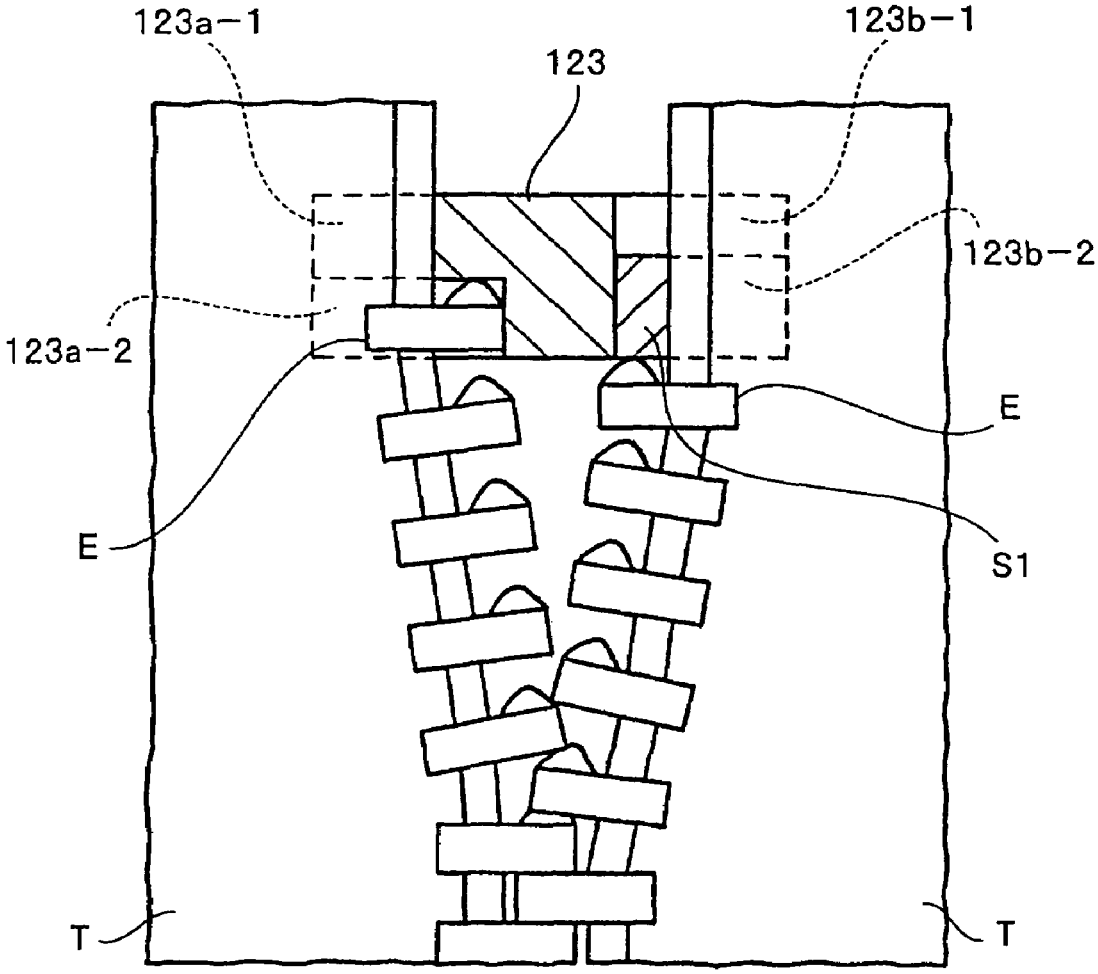
FIG. 10 is a partially enlarged rear view showing, with a cross section, a state in which the slider introduction member is kept in contact with right and left engaging elements disposed on a second end portion of the space portion.
Figure 11:
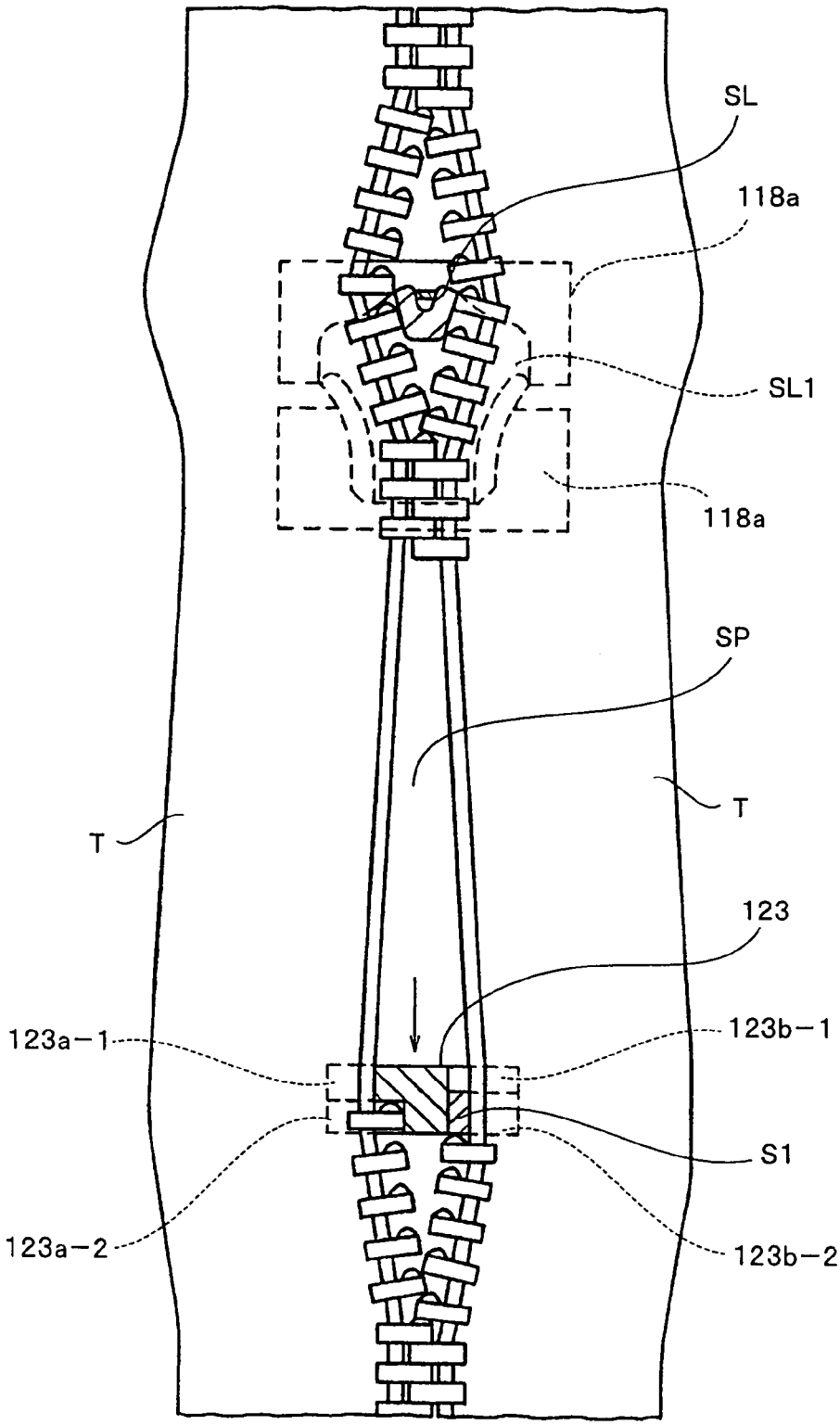
FIG. 11 is a rear view showing, partially with a cross section, a state in which the slider is introduced by the slider introduction member.

Here, the first cylinder 106 is actuated so as to lower the chain carrying unit 120 by a predetermined distance. The traveling distance at this time is a distance from the first position P1 in which the slider introduction member 123 thrusts into the space portion to the second position P2 in which the die 121 of the bottom end stop attaching member 113 opposes the punch portion 119 installed in the first arrangement area A. After starting descent from the first position P1, the slider introduction member 123 reaches the second end portion C2, which is a chain downstream end of the space portion SP, soon during its movement. Then, as shown in FIG. 10, the top end stop SI held by the expanded notch portion 123*b*-2 and the first notch portion 123*a*-1 come into contact with the engaging elements E, E attached to respective fastener tape portions of the second end portion C2 of the space portion SP. Up to then, no pulling force is applied to the slide fastener chain FC1.

Figure 12:
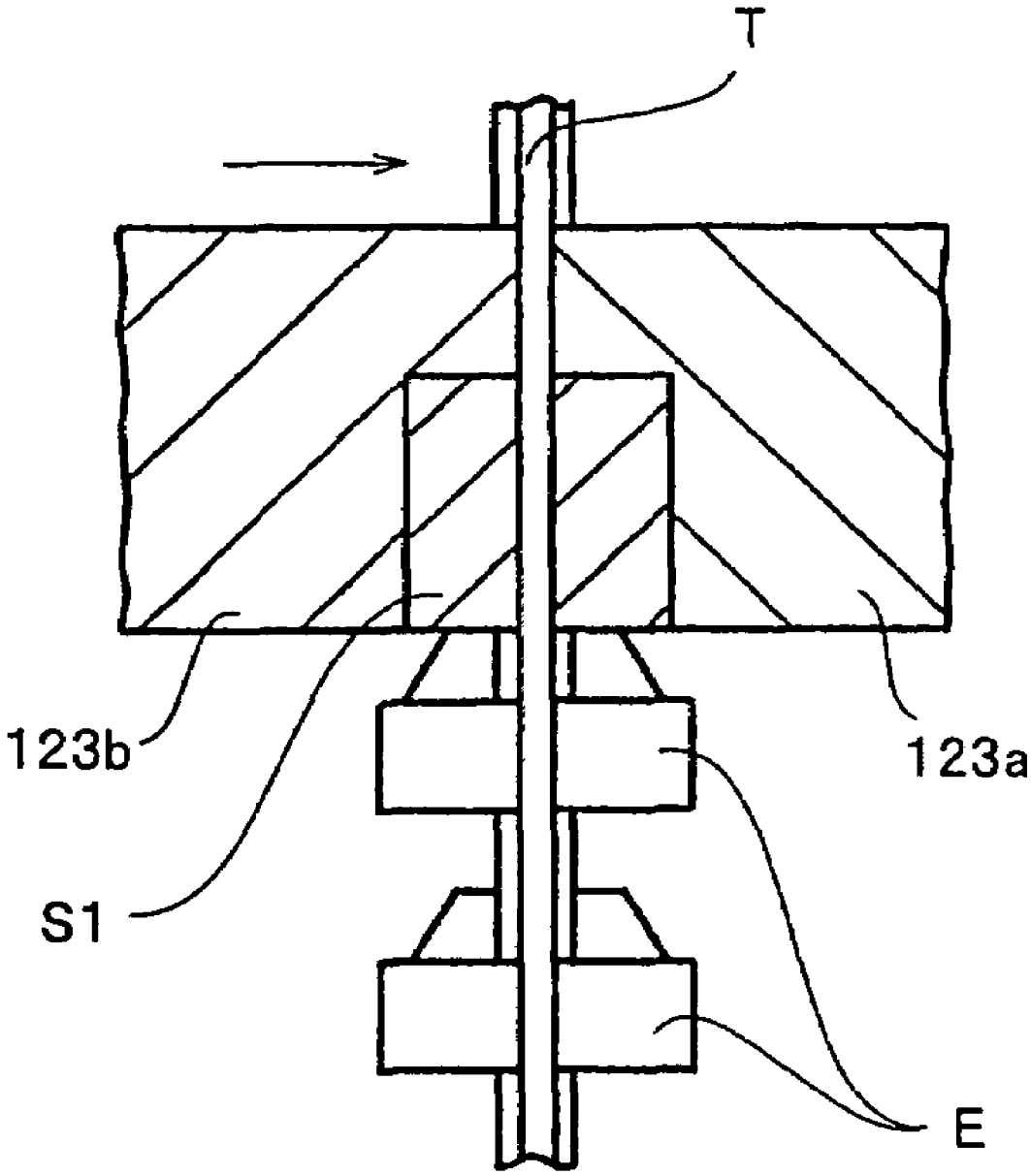
FIG. 12 is an explanatory view when the top end stop is clamped by sliding of a second member of the slider introduction member.

While the slider introduction member 123 moves, as shown in FIG. 12, the second member 123*b* of the slider introduction member 123 moves in a direction of narrowing a notch width of the expanded notch portion 123*b*-2 so that the top end stop S1 comes into contact with one of the engaging elements E attached to the fastener tape portion of the second end portion C2 of the space portion SP. When it reaches just before the second position P2 after continuing further descent, clamping of the top end stop S1 is just ended at that position, so that the top end stop S1 is attached to the fastener tape T. According to this embodiment, a fixed cam having a cam face (not shown) for pushing the second member 123*b* in a direction of narrowing the notch width of the second notch portion 123*b*-1 (expanded notch portion 123*b*-2) during the above-mentioned movement is disposed out of the chain carrying unit 120. The operation of the second member 123*b* is executed by pushing a rear end of the second member 123*b* as the chain carrying unit 120 lowers while sliding on the cam face of the fixed cam in a direction of narrowing the notch width of the second notch portion 123*b*-1.

The attachment of the top end stop S1 is completed as the descent of the chain carrying unit 120 is continued with the top end stop S1 held by the second notch portion 123*b*-1 and an engaging element kept in contact with the first notch portion 123*a*-1 at the same time. That is, the slider introduction member 123 grips one of the pair of right and left engaging elements disposed at the second end portion C2 in the downstream of the slide fastener chain of the space portion SP of the slide fastener chain FC1 and continues the descent keeping a contact with the other engaging element. In other words, the slide fastener chain FC1 is not carried with its right and left fastener tapes T gripped by a gripper or nipped between rollers unlike conventional method but carried with the engaging element E gripped or pushed. Thus, the fastener tape T is pulled through tape edge portions in which core thread difficult to expand or contract and consequently, no special tension is applied to the tape main body of the fastener tape T and at the same time, a positional relation of the pair of engaging elements E, E disposed at the second end portion C2 in the downstream of the slide fastener chain of the space portion SP is kept unchanged. As a result, fault due to deviation of the engaging elements E is totally eliminated. According to this embodiment, the drive roller 107 is rotated with a slight time lag from a carrying start of the slide fastener chain FC1 by the slider introduction member 123 so as to carry the slide fastener chain FC1 in a state in which the slider introduction member 123 is kept in contact with the top end stop S1 and the engaging element.

For an operation that the drive roller 107 is rotated synchronously with carrying of the slide fastener chain FC1 with the slider introduction member 123, electric means or mechanical means is adopted. For example, in case of the electric means, a control unit (not shown) which receives a carrying start signal of the slider introduction member 123 dispatches a drive start signal to the drive motor 107*a*, so that the drive roller 107 can be rotated with motion of the slider introduction member 123.

In case of the mechanical means, the chain carrying unit 120 is fixed with a rack and a pinion which can mesh with the same rack is fixed on a rotation shaft of the drive roller 107. When the slide fastener chain FC1 is carried by the slider introduction member 123, the drive roller 107 may be rotated forcibly corresponding to a movement of the chain carrying unit 120, that is, a movement of the slider introduction member 123, with a power supply for the drive motor turned OFF.

By rotating the drive roller 107 with the motion of the slider introduction member 123 as described above, a length of the slide fastener chain FC1W carried by the slider introduction member 123 may be equalized with a length fed to a discharge portion 102 which is a next step, by a rotation of the drive roller 107.

Just after the transportation of the slide fastener chain FC1 is started, a plurality of the engaging elements E on the right and left disposed at the first end portion C1 in the upstream of the chain of the space portion SP are inserted through a shoulder mouth of the slider SL as shown in FIG. 1. When the slider introduction member 123 reaches the second position P2 which is a lower limit position shown in FIG. 13 while an insertion of the engaging elements into the slider SL is carried out, a descent of the chain carrying unit 120 is stopped. At this time, the insertion of the engaging elements into the slider by the slider introduction member 123 is completed. The position of the first end portion C1 which is an end portion in the upstream of the space portion SP is set to stop at the attachment position of the bottom end stop S2 by the bottom end stop attaching member 113. When the descent of the chain carrying unit 120 is stopped, the fifth cylinder 125 installed on the chain carrying unit 120 is actuated in an expanding direction so that the die 121 which is part of a composition of the bottom end stop attaching member 113 and the space portion expanding member 122 which expands the space portion are advanced toward the bottom end stop attaching position of the slide fastener chain FC1.

Figure 14:
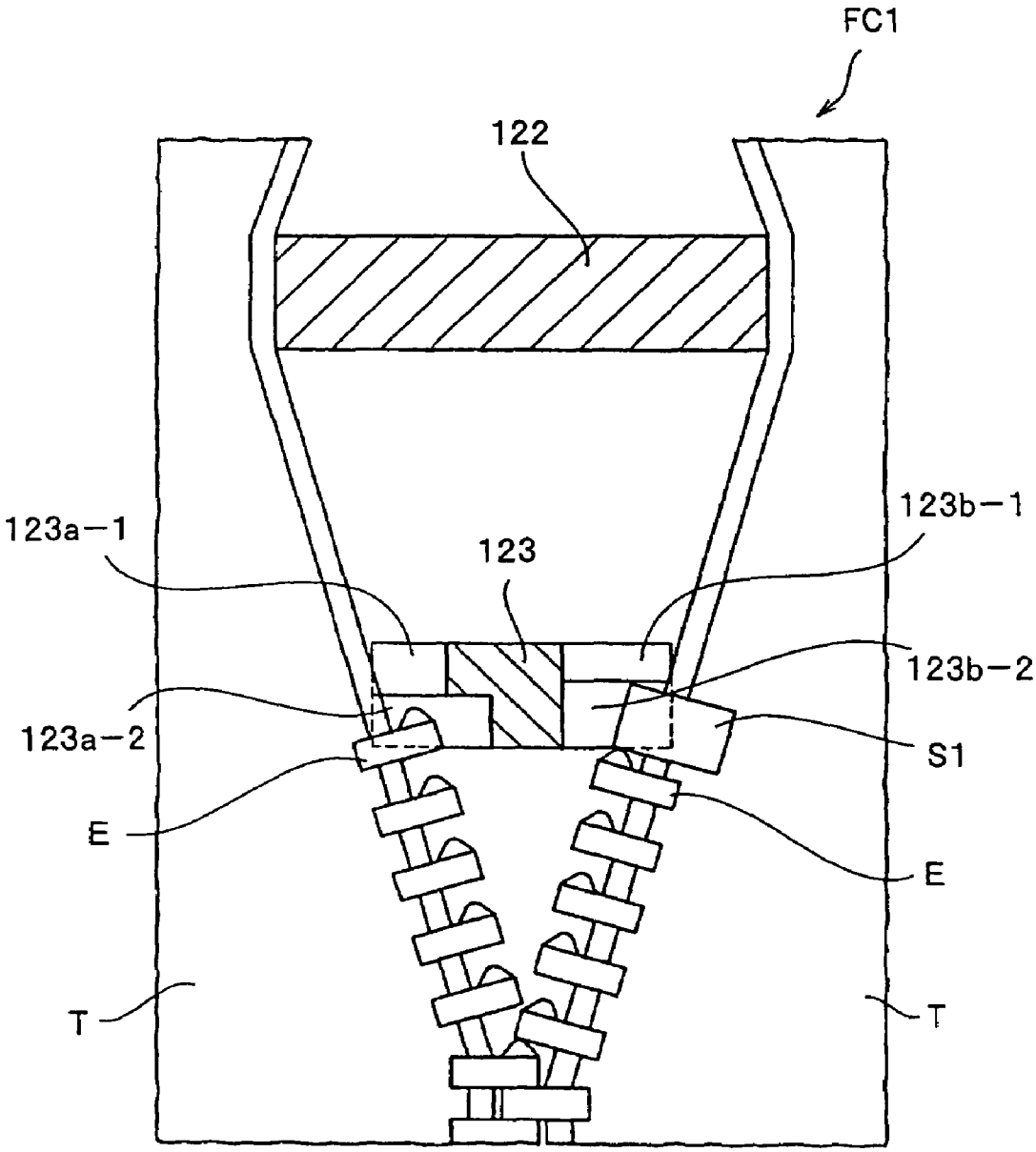
FIG. 14 is explanatory view showing a positional relation between an expansion width of the space portion when the space portion expanding member is inserted into the space portion and the slider introduction member.
Figure 15:
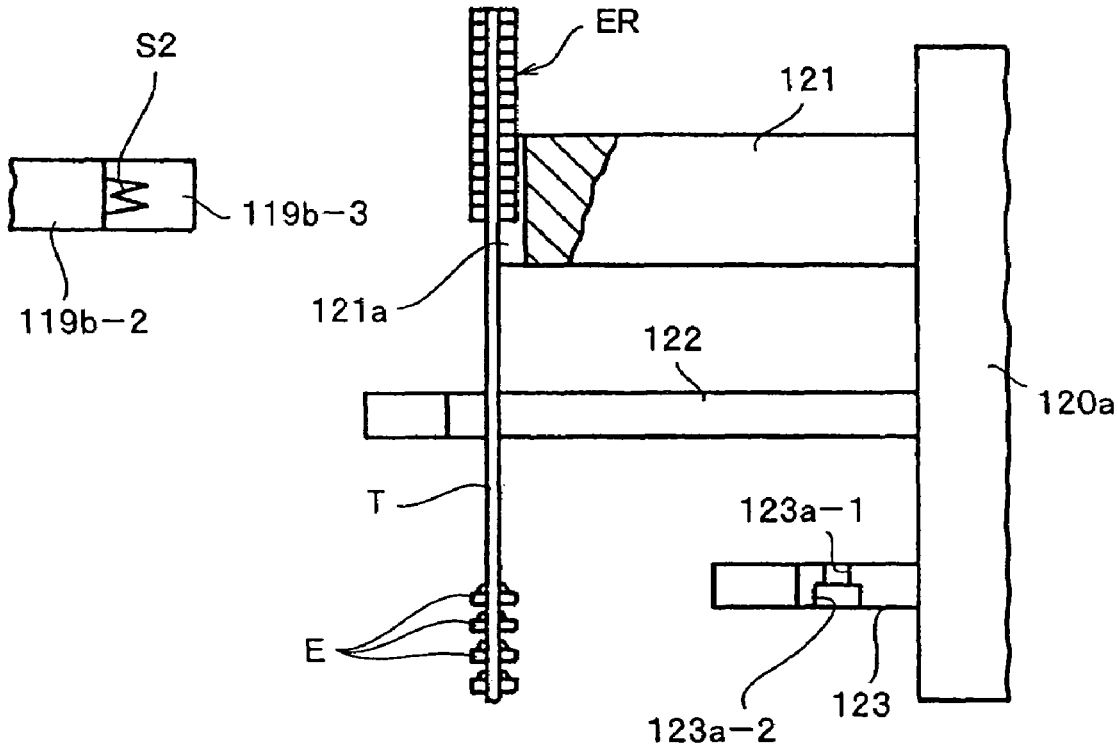
FIG. 15 is a side view showing a positional relation between a punch member and a die of the bottom end stop attaching member immediately before the bottom end stop is attached.

As shown in FIG. 15, a front end position of the space portion expanding member 122 is extended toward the slide fastener chain FC1 longer than the front end position of the die 121 and when the die 121 reaches the bottom end stop attaching position, the front end wedge portion of the space portion expanding member 122 has already thrust into the space portion SP thereby expanding the same space portion SP. An expansion width at this time is set to a width large enough for the fastener tape portion and top end stop S1 to loose out of the notch portion of the slider introduction member 123 as shown in FIG. 14. At the same time when the expansion of the space portion SP by the space portion expanding member 122 is ended, the slider introduction member 123 retreats in a direction of leaving the slide fastener chain FC1 so that it departs from the space portion SP as shown in FIG. 15.

Figure 16:
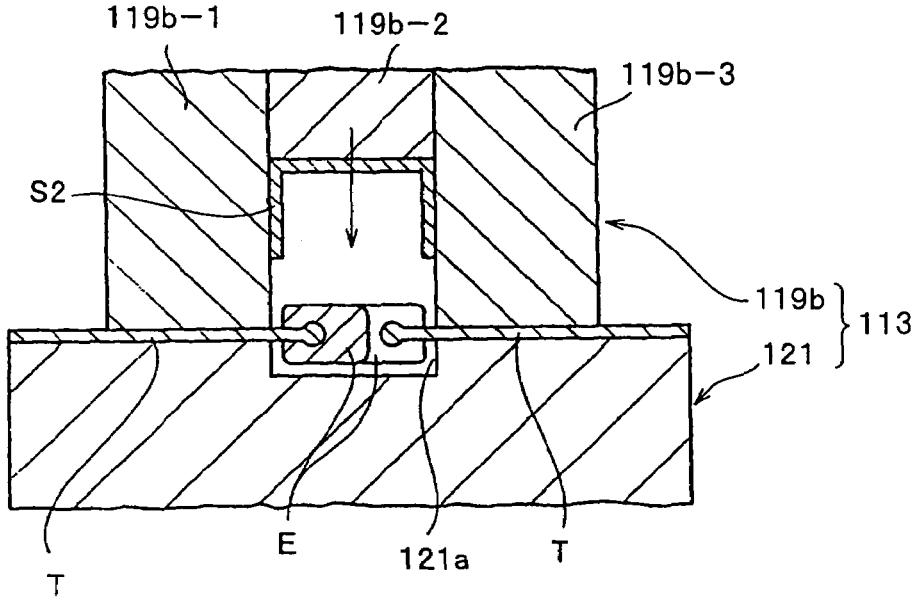
FIG. 16 is an explanatory view showing a bottom end stop clamping operation by the punch when the bottom end stop is attached.
Figure 17:
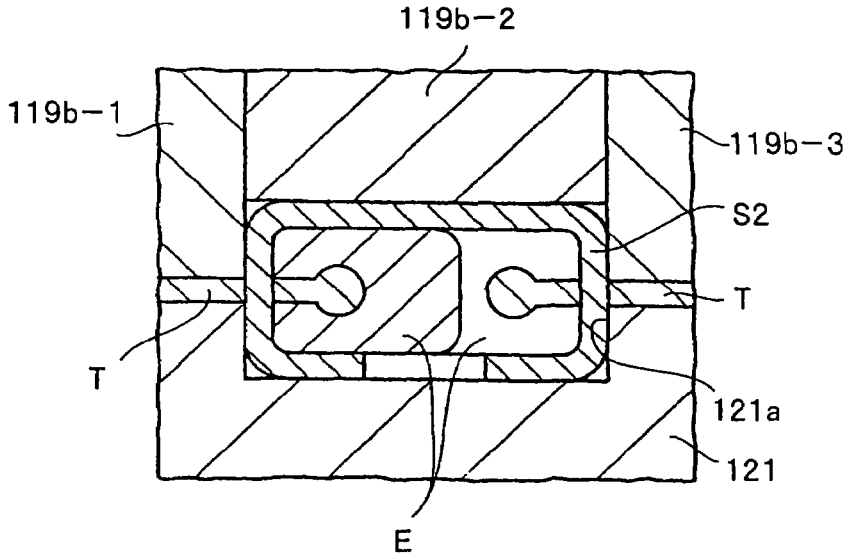
FIG. 17 is an explanatory view showing a moment when the bottom end stop is attached.

Following an advancement of the die 121, the third cylinder 119*a* provided on the first arrangement area A is actuated so as to advance the punch 119*b* toward the bottom end stop attaching position. When the first and third quadrangular prism pieces 119*b*-1 and 119*b*-3 that are components of the same punch 119*b* reach the bottom end stop attaching position shown in FIG. 16, the right and left fastener tapes T, T are nipped between a front end face of the die 121 which has already arrived at the bottom end stop attaching position and the first and third quadrangular prism pieces 119*b*-1, 119*b*-3. Here, the second quadrangular prism piece 119*b*-2 disposed in the center of the punch 119 is advanced toward the die 121 by an action of the third cylinder 119*a* so that a U-shaped bottom end stop S2 held between the first and third quadrangular prism pieces 119*b*-1 and 119*b*-3 is pushed and clamped. As a result, as shown in FIG. 17, the same bottom end stop S2 is attached such that the right and left fastener tapes T, T exposed adjacent to the engaging elements E, E disposed at the second end portion C2 of the space portion SP are jointed.

Figure 18:
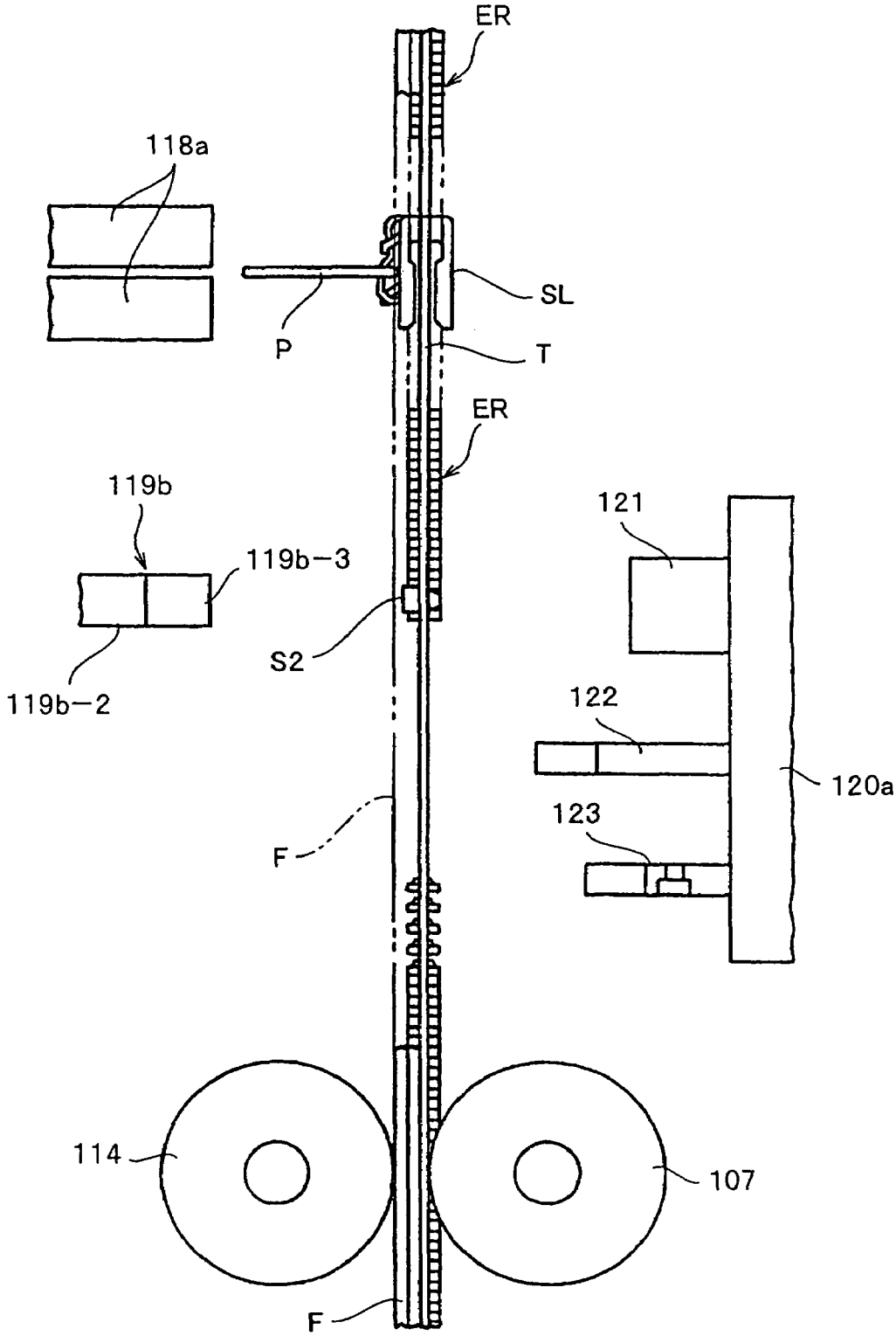
FIG. 18 is a side view showing a state in which finishing of the slider is completed.

After the attachment of the bottom end stop S2 is finished, the punch 119*b* and the die 121 leave the slide fastener chain FC1 and retracts to a position shown in FIG. 18. If this retraction is achieved, the first cylinder 106 is actuated in its shrinking direction, so that the chain carrying unit 120 returns to its original standby position shown in FIG. 1. At this time, the drive roller 107 begins to rotate so as to feed the slide fastener chain FC1 downward. As a result of repetition of the above-described operation, the top end stop S1 is attached to the second end portion C2 in the downstream of the slide fastener chain of the space portion SP of the continuous slide fastener chain FC and after the insertion of the engaging elements into the slider is finished, the bottom end stop S2 is attached to the first end portion C1 in the upstream of the slide fastener chain of the space portion SP. The continuous finishing operation is performed like this.

Figure 19:
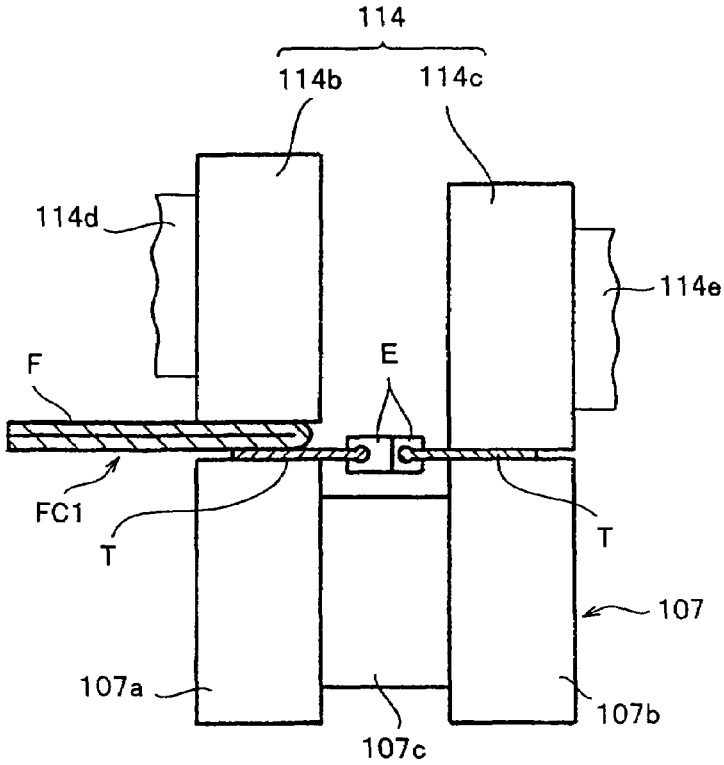
FIG. 19 is an explanatory view showing a configuration of a feed portion of the slide fastener chain with a fly.

Although, according to this embodiment, the slide fastener chain FC1 with a fly is finished as described above, an ordinary slide fastener chain FC2 with no fly like shown in FIG. 22 also can be finished in the same operation. In this case, in the above described drive roller and pressure roller, first roller portion and second roller portion disposed on right and left of each may be formed in a same diameter and supported independently on a each same shaft. However, in case of the slide fastener chain FC1 with a fly as shown in FIG. 19, because the fly F is sewed to one of the right and left fastener tapes T in the slide fastener chain FC1 and the fly F is folded when the slide fastener chain FC1 is carried, a thickness of a side on which the fly F is sewed is increased by a thickness corresponding to two pieces of the fly. Therefore, if the slide fastener chain FC1 is carried under a condition that the first and second roller portions of the drive roller 107 and the first and second roller portions of the pressure roller 114 are formed each in the same diameter and provided on each same shaft, contact force on a side on which the folded fly F is sewed is increased so that twisting is generated in the slide fastener chain FC1 thereby losing the stability of carrying. On the other hand, if the diameters of the first roller and the second roller of the pressure roller 114 are different, a difference is generated in feeding velocities of the right and left fastener tapes T so that the twisting is intensified more than the former case.

Thus, according to this embodiment, as shown in FIG. 19, the drive roller 107 is disposed so as to contact the fastener tape T on a side on which no fly F is sewed and the pressure roller 114 is disposed such that it is in contact with a tape face opposite to the drive roller 107 across the fastener tape T. A first roller portion 107*a* and a second roller portion 107*b* of the drive roller 107 have the same diameter and are supported by an identical shaft 107*c*. On the other hand, although the first and second roller portions 114*b*, 114*c* of the pressure roller 114 have the same diameter, they are supported by independent first and second shafts 114*d*, 114*e* while the first and second shafts 114*d*, 114*e* are not disposed on a same axis but a distance to the slide fastener chain FC1 is deviated by an amount corresponding to the thickness of two pieces of the fly F. Due to such an arrangement, when the slide fastener chain FC1 with the fly is sent out with the drive roller 107 and the pressure roller 114, no twisting force is applied to the slide fastener chain FC1 with the fly, so that the right and left fastener tapes T can be sent out securely and accurately under equal pressures with no difference in feeding velocity.

FIG. 20 shows a modification of the above-described embodiment and according to this modification, no top end stop S1 is attached and an engaging element attached to an end portion in the downstream (second end portion C2) of the slide fastener chain of the space portion SP of the slide fastener chain FC2 is carried by the slider introduction member 123. In this case, the slider introduction member 123 is constituted of only the first member 123*a*. The second notch portion 123*b*-1 formed in one side face in the right and left direction of the first member 123*a* is a notch portion having a single shape communicating between the front face and the rear face of the first member 123*a* and the second notch portion 123*b*-1 only guides the side edge of the fastener tape T in a inserted state, keeping the engaging element E disposed at the second end portion C2 of the space portion SP in contact with part of the first member 123*a* away from the second notch portion 123*b*-1. On the other hand, in the other side face in the right and left direction of the first member 123*a*, the engaging element E is accommodated in the expanded notch portion 123*a*-2 of the first notch portion 123*a*-1 like the above-described embodiment. As described above, the present invention allows a variety of modifications and is not restricted to the above-described embodiments.

What is claimed is:

1. A continuous finishing apparatus for a slide fastener, the apparatus comprising:

a slider introduction portion for successively introducing a slider by intermittently running a slide fastener chain in which a meshed engaging element row and a space portion having no engaging element are disposed alternately in a longitudinal direction;

a positioning opening and closing member capable of thrusting into and departing from the space portion of the slide fastener chain, the positioning opening and closing member opening and closing the space portion;

a slider holding member which is disposed in a downstream of the slide fastener chain relative to the positioning opening and closing member and which advances to and retreats from the space portion opened by the positioning opening and closing member; and a slider introduction member disposed in a downstream of the slide fastener chain relative to the slider holding member, the slider introduction member being capable of thrusting into and departing from the opened space portion; being reciprocated between a first position in the space portion and a second position in the downstream portion of the slide fastener chain; when it goes forward, supporting an engaging element disposed at a second end portion in the downstream portion of the slide fastener chain of the space portion and moving up to the second position while pulling the slide fastener chain so that the engaging element row disposed at a first end portion in an upstream of the slide fastener chain of the space portion is inserted into the slider held by the slider holding member.

2. The continuous finishing apparatus according to claim 1, wherein the positioning opening and closing member has a positioning function for positioning a stop position of the first end portion in the upstream of the slide fastener chain of the space portion.

3. The continuous finishing apparatus according to claim 1, wherein the slider introduction member also serves as a top end stop attaching member.

4. The continuous finishing apparatus according to claim 3, wherein the slider introduction member comprises:

notch portions which support a top end stop and guide fastener tape side edges of the space portion in engagement; and top end stop attaching means for attaching the top end stop supported by the notch portions to the second end portion of the space portion.

5. The continuous finishing apparatus according to claim 4, wherein the top end stop attaching means has changing means for changing a notch width of the notch portions.

6. The continuous finishing apparatus according to claim 1, further comprising bottom end stop attaching member disposed in the downstream of the slide fastener chain of the slider introduction member, for attaching a bottom end stop to the first end portion of the space portion.

7. The continuous finishing apparatus according to claim 6, further comprising a space portion expanding member which is disposed between the slider introduction member and the bottom end stop attaching member and which thrusts into the space portion so as to expand an opening width of the space portion.

8. The continuous finishing apparatus according to claim 1, wherein a feed roller portion comprising a drive roller and a pressure roller is further disposed at the second position in the downstream of the slide fastener chain, which is a mobility limit of one side for the slider introduction member, and the drive roller is synchronously rotatable with a motion of the slider introduction member.

9. The continuous finishing apparatus according to claim 7, wherein the bottom end stop attaching member has clamping means including a punch and a die, a positioning opening and closing member, a slider holding member and the punch of the bottom end stop attaching member are disposed in a first arrangement area on one side of a running plane of a slide fastener chain, and the die of the bottom end stop attaching member, the space portion expanding member and the slider introduction member are successively disposed in a downstream direction of the slide fastener chain in a second arrangement area on the other side of the running plane of the slide fastener chain.

10. The continuous finishing apparatus according to claim 9, wherein the positioning opening and closing member, the slider holding member and the punch of the bottom end stop attaching member are disposed at immobile positions, the die of the bottom end stop attaching member, the space portion expanding member and the slider introduction member are supported by a single supporting member and unitized, and the die and the space portion expanding member reciprocate in cooperation with a reciprocation of the slider introduction member between the first and second positions.

* * * * *